US011738434B2

(12) United States Patent
Wang

(10) Patent No.: US 11,738,434 B2
(45) Date of Patent: Aug. 29, 2023

(54) NAIL BOX COMPONENT, NAIL GUN, AND METHOD FOR REPLACING NAIL BOX COMPONENT OF NAIL GUN

(71) Applicant: ARROW FASTENER COMPANY, LLC, Saddle Brook, NJ (US)

(72) Inventor: Weiyi Wang, Hangzhou (CN)

(73) Assignee: Arrow Fastener Company, LLC, Saddle Brook, NJ (US)

( * ) Notice: Subject to any disclaimer, the term of this patent is extended or adjusted under 35 U.S.C. 154(b) by 66 days.

(21) Appl. No.: 17/006,559

(22) Filed: Aug. 28, 2020

(65) Prior Publication Data

US 2021/0268634 A1 Sep. 2, 2021

Related U.S. Application Data

(63) Continuation-in-part of application No. PCT/CN2020/077124, filed on Feb. 28, 2020.

(51) Int. Cl.
*B25C 7/00* (2006.01)
*B25C 1/00* (2006.01)

(52) U.S. Cl.
CPC ..... *B25C 7/00* (2013.01); *B25C 1/008* (2013.01)

(58) Field of Classification Search
CPC ..... B25C 7/00; B25C 1/008
See application file for complete search history.

(56) References Cited

U.S. PATENT DOCUMENTS 3,215,324 A * 11/1965 Dorney ..... B25C 5/16 227/123
3,760,695 A * 9/1973 Rothfuss ..... B25C 1/047 92/85 R
3,840,165 A * 10/1974 Howard ..... B25C 5/16 227/123
4,597,517 A * 7/1986 Wagdy ..... B25C 1/008 227/8

(Continued)

FOREIGN PATENT DOCUMENTS

CN 201002248 Y 1/2008
CN 104209926 A 12/2014

(Continued)

OTHER PUBLICATIONS

International Search Report and Written Opinion for PCT/CN2020/077124 dated Nov. 27, 2020; 10 pages including English translation.

*Primary Examiner* — Thomas M Wittenschlaeger
*Assistant Examiner* — Katie L Gerth
(74) *Attorney, Agent, or Firm* — Schwabe, Williamson & Wyatt, PC

(57) ABSTRACT

The present disclosure relates to a modular fastener gun comprising at least a gun body that can accept any number of fastener cartridges using a same connection assembly mechanism. In one example, a fastener cartridge comprises a fastener box used to hold fasteners, the fastener box including a first alignment structure and a second alignment structure, the first alignment structure used to detachably connect the fastener cartridge to a fastener gun body, and the second alignment structure used to lock the fastener cartridge to the gun body. In this way, a plurality of fastener cartridges that each can house different fastener types, can readily be used with a same fastener gun.

23 Claims, 24 Drawing Sheets

(56) References Cited

U.S. PATENT DOCUMENTS 4,671,443 A * 6/1987 Becht ..... B25C 5/1686 227/120
5,080,273 A * 1/1992 Meyer ..... B25C 1/043 227/8
6,189,759 B1 * 2/2001 Canlas ..... B25C 5/1675 227/127
6,679,413 B2 * 1/2004 Miller ..... B25C 1/045 227/120
7,980,441 B2 * 7/2011 Dittrich ..... B25C 1/005 227/120
8,061,437 B2 * 11/2011 Liang ..... B25C 1/00 173/118
9,827,658 B2 * 11/2017 Gregory ..... B25C 1/001
11,267,114 B2 * 3/2022 Meyer ..... B25C 1/001
2002/0104866 A1 * 8/2002 Miller ..... B25C 1/046 227/8
2003/0230622 A1 * 12/2003 Rotharmel ..... B25C 1/184 227/120
2006/0157528 A1 * 7/2006 Osuga ..... B25C 1/188 227/130
2008/0296337 A1 * 12/2008 Yang ..... B25C 1/008 227/8
2011/0215131 A1 * 9/2011 Liang ..... B25C 1/00 227/120
2011/0278342 A1 * 11/2011 Kuo ..... B25C 1/001 227/120
2015/0202755 A1 * 7/2015 Tanji ..... B25C 1/04 227/130
2018/0001451 A1 * 1/2018 Meyer ..... B25C 1/005
2020/0016731 A1 * 1/2020 Liao ..... B25C 1/008
2020/0223046 A1 * 7/2020 Hoshino ..... B25C 5/15

FOREIGN PATENT DOCUMENTS

CN 105215940 A 1/2016
CN 105215941 A 1/2016
CN 205219021 U 5/2016
CN 209648623 U 11/2019
JP 2012030297 A 2/2012
WO 2019/007575 A1 1/2019
WO 2021/168775 A1 9/2021

* cited by examiner

NAIL BOX COMPONENT, NAIL GUN, AND METHOD FOR REPLACING NAIL BOX COMPONENT OF NAIL GUN

CROSS-REFERENCE TO RELATED APPLICATIONS

This application is a continuation in part of PCT Application No. PCT/CN2020/077124, filed Feb. 28, 2020, the entire disclosure of which is incorporated herein by reference.

TECHNICAL FIELD

The present disclosure relates to the field of powered-actuated tools, and more specifically, to a modular fastener gun capable of receiving a plurality of different fastener cartridges.

BACKGROUND

Fastening devices, such as fastener gun, are handheld fastening tools. At present, commercially available fastener guns can be divided into pneumatic fastener guns, electric fastener guns, manual fastener guns, gas fastener guns, etc. according to different power sources. The main structure thereof is generally composed of a main body part (mainly used to transfer power) and a fastener supply part (or a fastener box part). At present, the main body part of many different models of fastener guns is universal, but the fastener box part is different according to the specification of fasteners, and thus different models of fastener guns are formed in a manner that increases customer costs, increases usage of raw materials, and reduces customer satisfaction with regard to operational use.

SUMMARY

To overcome the deficiencies in the prior art, one of the objectives of the present disclosure is to provide a fastener box component (also referred to herein as a fastener cartridge) and a fastener gun, which are convenient to use. Another objective of the present disclosure is to provide a method for replacing a fastener box component of a fastener gun.

To achieve the above objective, the present disclosure is implemented through the following technical solutions.

In a first representative example, a fastener gun comprises a gun body, and a fastener box component. The fastener box component may include a fastener accommodating cavity and a fastening channel. The fastening channel may be in communication with the fastener accommodating cavity. The fastener accommodating cavity may be used to accommodate fasteners, and the fastening channel may be used to provide a channel (e.g., fastener delivery path) through which a fastener is launched (e.g., driven) out of the fastener box component. In an example, the fastener box component may be detachably connected to the gun body.

According to an embodiment of the present disclosure, there may be a plurality of fastener box components. The plurality of fastener box components may be respectively detachably connected to one same gun body in a same connection manner.

According to an embodiment of the present disclosure, the fastener box component may be connected to the gun body by a connecting piece and/or a locking piece.

According to an embodiment of the present disclosure, the fastener box component may be connected to the gun body by the connecting piece in a manner that does not in and of itself restrict the fastener box component from relatively moving in a disassembly direction. In an embodiment, the locking piece may restrict the fastener box component and the gun body from relatively moving in a disassembly direction.

According to an embodiment of the present disclosure, the fastener gun may further comprise a first alignment structure. The connecting piece may fit with the first alignment structure such that the gun body is detachably connected to the fastener box component. The connecting piece may be arranged on one of the fastener box component and the gun body. The first alignment structure may be arranged on the other of the fastener box component and the gun body.

According to an embodiment of the present disclosure, the connecting piece may be a first pin post, a second pin post, a dovetail, and/or a tenon. The first alignment structure may be a first pin hole, a first groove, a dovetail groove, and/or a mortise.

According to an embodiment of the present disclosure, the fastener gun may further comprise a second alignment structure. The locking piece may fit with the second alignment structure to restrict the gun body and the fastener box component from relatively moving in a disassembly direction. The locking piece may be arranged on one of the fastener box component and the gun body. The second alignment structure may be arranged on the other of the fastener box component and the gun body.

According to an embodiment of the present disclosure, the locking piece may be a locking hook that may be movably arranged. The second alignment structure may be a pin shaft. The locking hook may be configured to, after being moved, hook the pin shaft and unhook the pin shaft. In another example, the locking piece may be a knob. In such an example, the second alignment structure may be a pin. The knob may be rotatably arranged, and the knob may be configured to hook the pin after being rotated. In another example, the locking piece may be an eccentric piece. The second alignment structure may be a stop block. The eccentric piece may be rotatably arranged. The eccentric piece may be configured to, after being rotated, stop the stop block to prevent the fastener box component from being detached from the gun body. In yet another example, the locking piece may be a sliding block, and the second alignment structure may be a second groove. The sliding block may be movably arranged. The sliding block may be configured to, when being moved, be inserted in the second groove or move out of the second groove.

According to an embodiment of the present disclosure, the locking piece may be a sliding block, and the second alignment structure may be a second groove. The fastener gun may further comprise an actuator (e.g., button, switch, rotatable knob, etc.). The actuator may be movably arranged. The actuator may be configured to, when being moved, drive the sliding block to move the sliding block out of the second groove.

According to an embodiment of the present disclosure, the sliding block may be arranged inside the gun body, and when the actuator is moved, the actuator may abut against the sliding block to move the sliding block.

According to an embodiment of the present disclosure, the fastener gun may further comprise a first elastic reset device and/or a second elastic reset device. In such an example, when the sliding block is moved, the first elastic reset device may be deformed to generate an elastic force by which the sliding block is reset. When the actuator (e.g., button, knob, switch, etc.) is moved, the second elastic reset device may be deformed to generate an elastic force by which the actuator is reset.

According to an embodiment of the present disclosure, the eccentric piece may be rotatably arranged on the gun body. In such an example, the stop block may be arranged on the fastener box component. After the fastener box component is installed on the gun body, the eccentric piece may be located, after being rotated, in a direction in which the stop block is disassembled from the fastener box component so as to prevent the stop block from being disassembled from the fastener box component.

According to an embodiment of the present disclosure, one end of the eccentric piece may be provided with a clamping pin, and the other end thereof may be provided with a handle. The clamping pin may be configured so as to protrude from the eccentric piece. The clamping pin and the handle may respectively be located on two sides of the gun body. The gun body may include with a fourth groove. The fourth groove may be used to accommodate the clamping pin, and the clamping pin may be configured to be able to enter the fourth groove and move out of the fourth groove. A fifth elastic reset device may be arranged between the handle and the gun body. The fifth elastic reset device may be configured to be elastically deformable. The handle may be pressed to enable the clamping pin to move out of the fourth groove and to enable the fifth elastic reset device to deform to generate an elastic force. The elastic force of the fifth elastic reset device may enable the clamping pin to abut against the gun body, and rotating the handle may enable the eccentric piece to stop the stop block. When the clamping pin is located outside the fourth groove, the eccentric piece is in a state of stopping the stop block.

According to an embodiment of the present disclosure, the gun body may be provided with a counterbore. The clamping pin may be located in the counterbore. The counterbore may have a stop wall provided therein. The stop wall may be located on a rotating path of the clamping pin and may be used to restrict a rotation angle of the clamping pin.

According to an embodiment of the present disclosure, the fastener gun may in some examples comprise a sixth elastic reset device. In such an example, the locking hook may be rotatably arranged. When the locking hook is rotated to enable the locking hook to unhook the pin shaft, the locking hook may be configured to enable the sixth elastic reset device to generate elastic deformation or have increased deformation.

According to an embodiment of the present disclosure, a pin may comprise a pin body and a pin cap. The pin cap may be connected to the pin body and may protrude from the pin body. In such an example, the knob (e.g., locking piece) may be provided with an accommodating cavity, an inlet, and a curved groove. The inlet and the curved groove may both be in communication with the accommodating cavity. The pin cap may be allowed to enter the accommodating cavity through the inlet. The pin body may be movable along the curved groove. When the pin body moves along the curved groove, the pin cap may be restricted to move in the accommodating cavity.

According to an embodiment of the present disclosure, the fastener gun may comprise a power member, which may be movably arranged. The fastener gun may comprise a fastening member. The fastening member may be used to be driven by the power member to move to launch a fastener. The fastening member may be located on a movement path of the power member. The power member may be detachably connected or non-detachably connected to the fastening member. In an example, after the fastening member is connected to the power member, the fastening member may be driven by the power member to move, for example upon actuation of a trigger associated with the fastener gun.

According to an embodiment of the present disclosure, the power member may be configured to be driven by a power source (e.g., air, gas, electricity, manual power) to bidirectionally move back and forth.

According to an embodiment of the present disclosure, the fastening member may be arranged on the fastener box component. In such an example, when the fastener box component is connected to the gun body, the fastening member may be detachably connected to the power member. Further, after the fastening member is connected to the power member, the fastening member may be driven by the power member to move relative to the fastener box component.

According to an embodiment of the present disclosure, the fastening member may be arranged in the fastening channel. The fastener box component may be provided with a restriction piece. The restriction piece may be movably arranged. The restriction piece may act on the fastening member to restrict the fastening member in the fastening channel After the restriction piece is moved, the restriction on the fastening member may be released.

According to one embodiment of the present disclosure, the fastening member is detachably connected or non-detachably connected to the power member.

According to one embodiment of the present disclosure, the fastening member may be detachably connected to the power member in a manner such that one of the fastening member and the power member is provided with a convex post, and the other may be provided with a notch. The convex post may be embedded in the notch such that the fastening member is detachably connected to the power member. In another example, one of the fastening member and the power member may be provided with a third pin post, and the other is provided with a second pin hole. The third pin post may be inserted in the second pin hole such that the fastening member may be detachably connected to the power member.

According to an embodiment of the present disclosure, the fastener gun may comprise a guide structure and a fitting structure. The fitting structure may fit with the guide structure to guide the installation and disassembly of the fastener box. The guide structure may be arranged on one of the gun body and the fastener box component. The fitting structure may be arranged on the other of the gun body and the fastener box component.

According to an embodiment of the present disclosure, the guide structure and the fitting structure may be configured as follows. In an example, the guide structure may be one of a dovetail and a dovetail groove, and the fitting structure may be the other of the dovetail and the dovetail groove. In another additional or alternative example, the guide structure may be one of a tenon and a mortise, and the fitting structure may be the other of the tenon and the mortise. In another additional or alternative example, the guide structure may be one of a convex block and a third groove, and the fitting structure may be the other of the convex block and the third groove.

According to an embodiment of the present disclosure, the gun body may comprise a crossbeam, and the guide structure or the fitting structure may be arranged on the crossbeam.

In a second representative example of the present disclosure, a fastener box component may comprise a fastener box used to hold fasteners. The fastener box may be provided with a first alignment structure and a second alignment structure. The first alignment structure may be used to be detachably connected to a gun body; and the second alignment structure may be used to lock the gun body.

According to an embodiment of the present disclosure, the fastener gun may further comprise a fastening member that may be detachably connected to a power member on the gun body so as to be driven by the power member to launch a fastener out of the fastener box. The fastener box component may be provided with a fastening channel. The fastening member may be detachably arranged in the fastening channel.

According to an embodiment of the present disclosure, the fastening member may be arranged in the fastening channel. The fastener box component may be provided with a restriction piece, and the restriction piece may be movably arranged. The restriction piece may act on the fastening member to restrict the fastening member in the fastening channel. After the restriction piece is moved, the restriction on the fastening member may be released.

According to an embodiment of the present disclosure, the restriction piece may be a ball or a shaft pin. The fastening member may be provided with a recess fitting with the ball or may be provided with a through hole fitting with the shaft pin.

According to an embodiment of the present disclosure, the fastener box component may further comprise a third elastic reset device. In such an example, when the restriction piece is moved under a force, the restriction piece may act on the third elastic reset device to enable the third elastic reset device to deform to generate an elastic force by which the restriction piece is reset to a position where the fastening member is restricted.

According to an embodiment of the present disclosure, the fastener box may be provided with a fastener accommodating cavity. The fastener accommodating cavity may be used to accommodate fasteners. A fourth elastic reset device may be provided in the fastener accommodating cavity. The fourth elastic reset device may be used to apply a force on a fastener to push the fastener to a desired position.

According to an embodiment of the present disclosure, the fourth elastic reset device may comprise a fourth spring. The fastener pushing piece may be provided in the fastener accommodating cavity. The fastener pushing piece may be connected to the fourth spring. An elastic force of the fourth spring may drive the fastener pushing piece such that the fastener pushing piece pushes a fastener to move.

In another representative example of the present disclosure, a method for replacing a fastener box component of a fastener gun may comprise providing a gun body, with a power member being provided on the gun body; providing a fastener box component, and detachably connecting the fastener box component to the gun body; providing a fastening member, wherein the fastening member is firstly connected to the power member, and then the fastener box component is connected to the gun body. In an alternative example, the fastening member may be detachably connected to the fastener box component, and when the fastener box component is connected to the gun body, the fastening member may be connected to the power member. The method may further comprise removing the fastener box component from the gun body, and then replacing the removed fastener box component with another fastener box component, or in some examples the same fastener box component reloaded with same or different fasteners.

According to an embodiment of the present disclosure, the power member may have an initial position and an end position during movement. The power member may drive the fastening member to launch a fastener during the movement from the initial position to the end position. In an example, when the fastening member is firstly connected to the power member, the power member may drive the fastening member to move to a position where the occurrence of the fastener box component being prevented from installation can be avoided, and then the fastener box component may be connected to the gun body. In another example, where the fastening member is firstly connected to the fastener box component and then connected to the power member, the initial position may overlap the end position. In such an example, after the power member is moved to the end position, the fastener box component may be connected to the gun body, and at the same time the power member may be connected to the fastening member.

In another representative example of the present disclosure, a modular fastener gun may comprise a gun body, and a fastener cartridge. The fastener cartridge may include both a fastener accommodating box for storing one or more fasteners and a connecting base having a fastening channel for ejection of one of the one or more fasteners. The fastener cartridge may be removably attached to the gun body via a first connection between a first position on the fastener cartridge and a second position on the gun body, and via a second connection between a third position on the fastener cartridge and a fourth position on the gun body.

According to an embodiment of the present disclosure, the gun body may further comprise a driving portion coupled to a grasping portion. The grasping portion may be for gripping the gun body and the driving portion may house a power member for ejection of one of the one or more the fasteners. In such an example, the first connection may adjoin the connecting base to the driving portion.

According to an embodiment of the present disclosure, a fastening member may move at least partly within the fastening channel and in conjunction with the power member for ejection of one of the one or more fasteners. The fastening member may be physically coupled to the power member responsive to forming the first connection, or may be physically coupled to the power member prior to forming the first connection.

According to an embodiment of the present disclosure, the power member may be driven by a source of energy. The source of energy may include one or more of air, gas, electricity and manual energy.

According to an embodiment of the present disclosure, the first position may correspond to a connector piece and the second position may corresponds to a first alignment structure, or vice versa. In such an example, the first connection may connect the first position and the third position in a manner that does not prevent the fastener cartridge from being detached from the gun body provided that the second connection is not established.

According to an embodiment of the present disclosure, the third position may correspond to a locking piece and the fourth position may correspond to a second alignment structure, or vice versa. The second connection may lock the fastener cartridge to the gun body to prevent the fastener cartridge from becoming detached from the gun body.

According to an embodiment, the gun body may further comprise a fitting structure and the fastener cartridge may further comprise a guide structure, or vice versa. In such an example, the fitting structure may fit with the guide structure to guide attachment of the fastener cartridge to the gun body.

According to an embodiment, the fastener cartridge may be one of a plurality of different fastener cartridges, where each of the plurality of different fastener cartridges may be capable of storing different fastener types. In such an example, each of the plurality of different fastener cartridges may be releasably attached to the gun body.

According to an embodiment, the fastener accommodating box may be capable of being reloaded with fasteners of a same or of a different type.

According to an embodiment, the first connection may be held in place at least in part via establishment of the second connection.

According to an embodiment, the fastener may be one of a nail, a staple, a pin or a rivet.

Thus, discussed herein, the first alignment structure in the present disclosure may be a structure that fits with the connecting piece, and may be used to achieve detachable connection between the fastener box component and the gun body. The second alignment structure may be a structure that fits with the locking piece, and may be used to lock the fastener box component and the gun body. The fitting structure may be a structure that fits with the guide structure, and may be used to guide the fastener box component and the gun body during installation and disassembly of the fastener box component and the gun body.

According to the fastener box component, the fastener gun, and the method for replacing a fastener box component of a fastener gun of the present disclosure, multiple fastener box components may fit with the same gun body in a same connection manner. The fastener box components may be detachable and replaceable, such that one gun body can be equipped with multiple fastener box components, and each fastener box component may hold one specification of fasteners. This may not only reduce the purchase cost of users, but may also satisfy the needs of quickly changing fasteners of different models. The fastening member may be respectively arranged, or may be arranged on the fastener box component and connected to the power member as the fastener box component is installed on the gun body, so that there are a variety of operation manners and the use thereof is convenient. The same fastening member may fit with multiple fastener box components. The connecting piece fits in accordance with the locking piece, which can not only conveniently install and remove the fastener box component, but also ensure that the fastener box component is firmly installed during use.

Compared with the prior art, the fastener gun provided in the present disclosure has at least a number of advantages. Examples include reduced purchase costs to users, being suitable for using various models of fasteners, simple structure and manufacturing process with low production costs, small volume associated with low transportation costs, and convenient use.

DETAILED DESCRIPTION OF THE PREFERRED EMBODIMENTS

Figure 49:
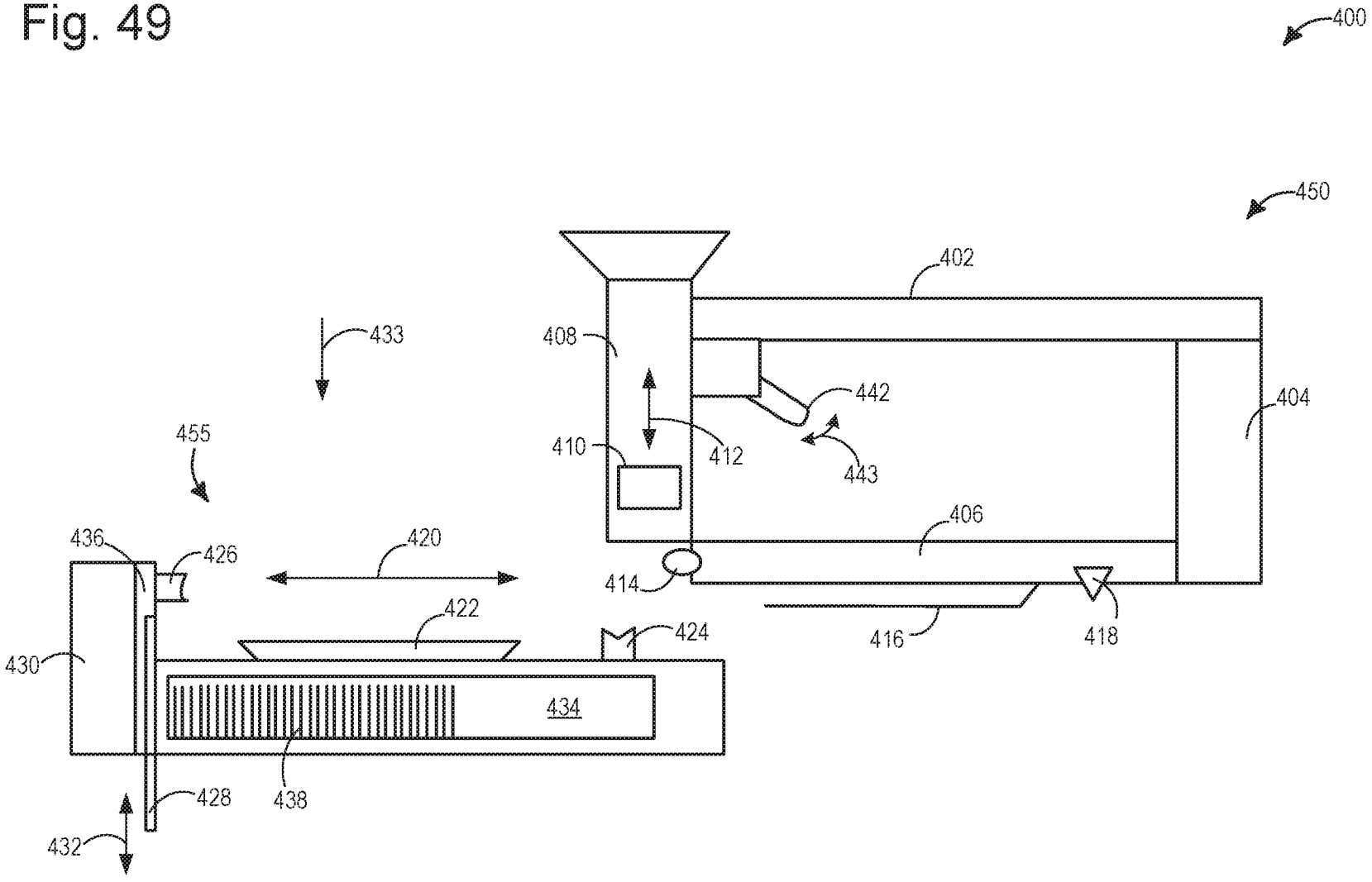
FIG. 49 is a high-level schematic illustration of a fastener gun and a fastener box component of the present disclosure.

A number of different embodiments herein are described in detail corresponding to at least a fastener box component, and a fastener gun. Briefly, before describing each embodiment in detail, FIG. 49 illustrates a high-level schematic of a fastener gun 400 comprising a gun body 450 (e.g., gun body 1 at FIG. 1) and a fastener box component 455 (e.g., fastener box component 2 at FIG. 1) of the present disclosure. Fastener box component 455 is also referred to herein as simply, fastener box 455 or fastener cartridge 455. It may be understood that fastener gun 400 at FIG. 49 is a representative example to highlight relevant aspects in common to embodiments below, but that various components discussed with regard to fastener gun 400 may be included or may not in different embodiments. Furthermore, variations in terms of arrangement of components discussed at FIG. 49 are within the scope of this disclosure, elaborated in greater detail in the different embodiments discussed below. Still further, it may be understood that FIG. 49 represents a high-level example to capture themes of the present disclosure with respect to the gun body 450 and the fastener box component 455, and thus various embodiments herein may include additional and/or alternative components not discussed with regard to FIG. 49, without departing from the scope of this disclosure.

Discussed herein, fasteners may include but are not limited to staples, nails, brass fasteners, tacks, pins (e.g., cotter pin, dowel, etc.), rivets, and the like. Furthermore, fastener guns as disclosed herein may comprise pneumatic fastener guns, electric fastener guns, manual fastener guns, gas fastener guns, and the like.

Figure 1:
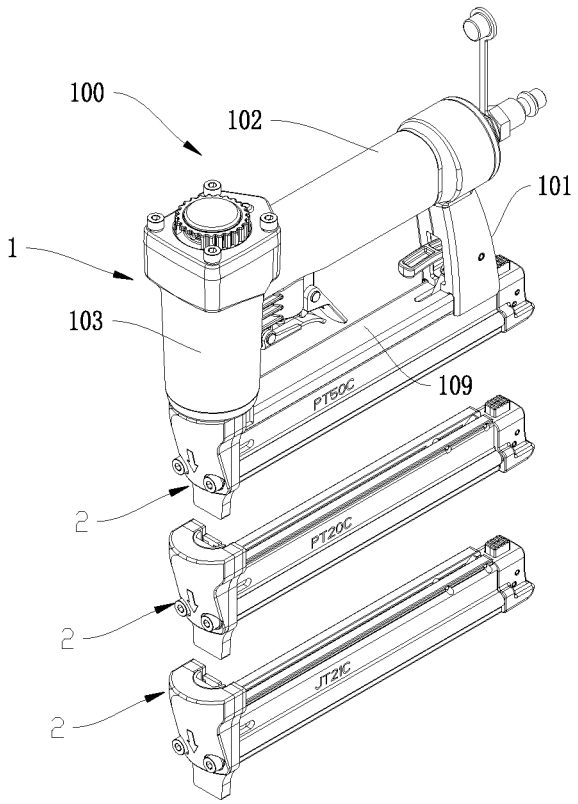
FIG. 1 is a schematic perspective structural diagram of a fastener gun according to Embodiment 1 of the present disclosure.

Gun body 450 may include connecting portion 404 (e.g., connecting portion 101 at FIG. 1), grasping portion 402 (e.g., grasping portion 102 at FIG. 1), driving portion 408 (e.g., driving portion 103 at FIG. 1), and crossbeam 406 (e.g., crossbeam 109 at FIG. 1). In some examples, grasping portion 402 may include a gas storage cavity (not shown) or storage cavity for some other actuator (e.g., motor) for driving a power member 410 (e.g., power member 13 at FIG. 1) in the direction (e.g., bidirectional) of arrows 412. It may be understood that movement of the power member 410 provides a drive mechanism for driving a fastener into a medium (e.g., wood, drywall, plywood, cement, and the like). The movement of the power member 410 may be initiated via actuation of a trigger 442, movable in the general direction illustrated by arrows 443.

Figure 14:
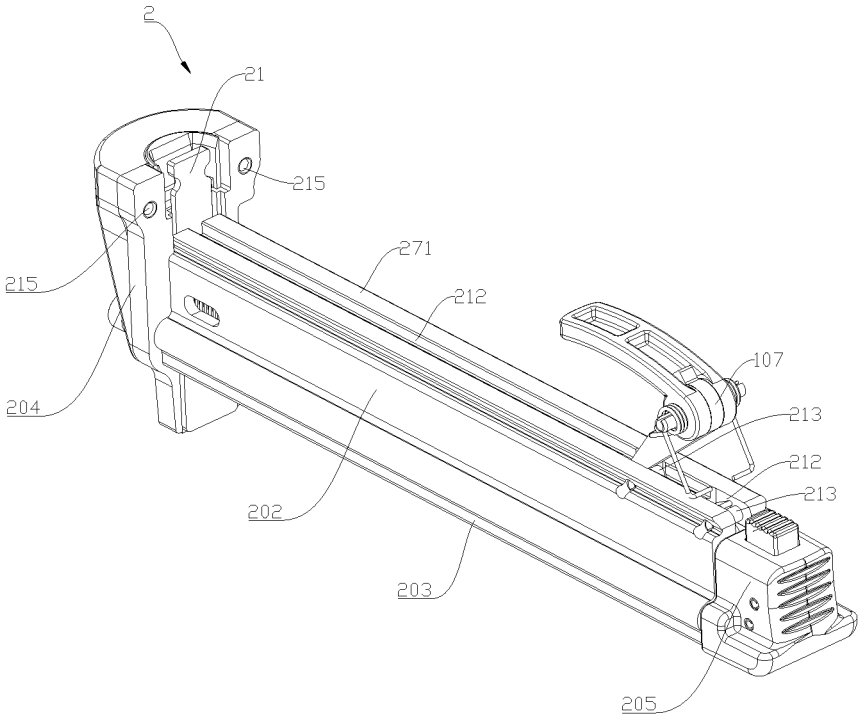
FIG. 14 is a schematic structural diagram of a fastener box component according to the present disclosure.
Figure 15:
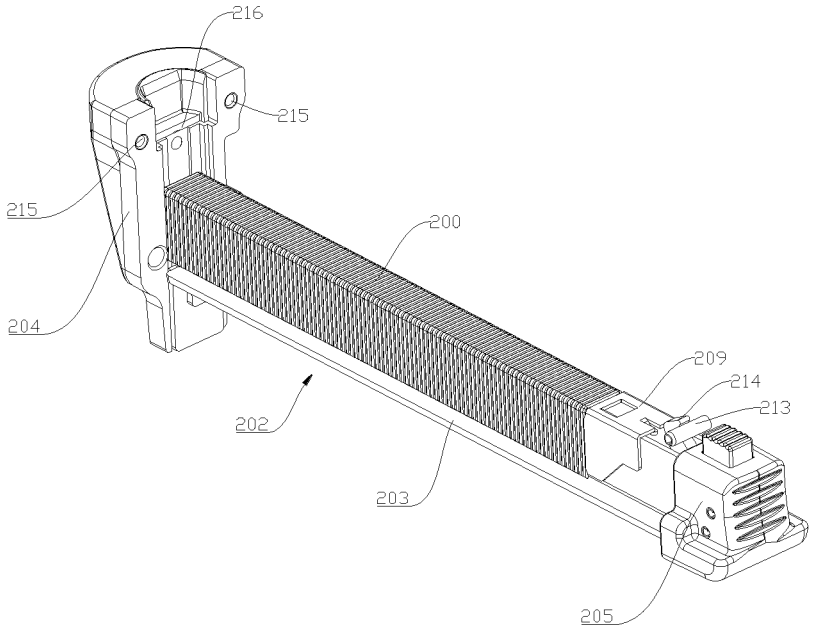
FIG. 15 is a schematic structural diagram of a fastener box component with a fastener accommodating box removed and a staple according to the present disclosure.

Fastener cartridge 455 includes a fastener accommodating box 434 (e.g., fastener accommodating box 202 at FIG. 14) for storing fasteners 438 (e.g., fasteners 200 at FIG. 15), and connecting base 430 (e.g., first connecting base 204 at FIG. 15). Connecting base 430 may include fastening channel 436 (e.g., fastening channel 216 at FIG. 16A). Fastening channel 436 may penetrate connecting base 430 from top to bottom, and may be used for launching a fastener 438. Fastening member 428 (fastening member 21 at FIG. 5) is included in fastening channel 436. Fastening member 428 may be coupled to power member 410, and may be driven by power member 410 to move in order to launch a fastener 438. Arrows 432 depict a manner in which fastening member 428 can move. It may be understood that movement of power member 410 in a downward direction (refer to arrow 433) may in turn drive fastening member 428 to also move in a downward direction, to thereby eject a fastener 438 from fastening channel 436. While not explicitly illustrated at FIG. 49, it may be understood that in some examples fastening member 428 may be physically coupled to power member 410 upon the attaching of fastener cartridge 455 to gun body 450. Furthermore, it is within the scope of this disclosure that in some examples fastening member 428 may be arranged as part of gun body 450 and coupled to power member 410 prior to attaching fastener cartridge 455 to gun body 450.

It may be understood that fastener cartridge 455 may be detachably coupled to gun body 450. Gun body 450 may be capable of receiving a plurality of different fastener cartridges 455. Each of the plurality of different fastener cartridges 455 may hold different fasteners 438, or may in other examples comprise same fasteners 438. In this representative example at FIG. 49, coupling and decoupling (e.g., attaching and detaching) of the fastener cartridge 455 to gun body 450 may be understood to be via a general direction of arrows 420.

Gun body 450 may include a first alignment structure 414. First alignment structure 414 associated with gun body 450 may fit with connecting piece 426 associated with fastener cartridge 455. First alignment structure 414 may comprise any one or more of a groove, pin hole, dovetail groove, mortise, bore, or other female connector of desired sizing and shaping. Connecting piece 426 may comprise one or more of a pin post, dovetail, tenon, dowel pin, or other male connector of desired sizing and shaping to fit with first alignment structure 414. It may be understood that in some examples, first alignment structure 414 may be included as part of fastener cartridge 455 while connecting piece 426 may be included as part of gun body 450, without departing from the scope of this disclosure. There may be one first alignment structure 414 and one connecting piece 426 in some examples, whereas in other examples there may be a plurality of connecting pieces 426 and a plurality of first alignment structures 414.

Gun body 450 may additionally or alternatively include second alignment structure 418. Second alignment structure 418 associated with gun body 450 may fit with locking piece 424 associated with fastener cartridge 455. As examples, second alignment structure 418 may comprise one or more of a pin shaft, pin, pin body and pin cap, stop-block, groove, clamping pin, etc. Locking piece 424 may comprise one or more of a locking hook (e.g., moveably arranged), a knob (e.g., rotatably arranged), an eccentric piece (e.g., rotatably arranged), a sliding block, etc. In some examples an actuator (e.g., button, knob, etc.), not shown at FIG. 49, may be included to enable the locking piece 424 and second alignment structure 418 to engage and disengage. It may be understood that in some examples, second alignment structure 418 may be included as part of fastener cartridge 455 while locking piece 424 may be included as part of gun body 450, without departing from the scope of this disclosure. There may be one second alignment structure 418 and one locking piece 424 in some examples, although in other examples there may be a plurality of second alignment structures 418 and/or a plurality of locking pieces 424.

Fastener gun 400 may further comprise one or more guide structures and one or more fitting structures. As an example, FIG. 49 depicts guide structure 416 associated with gun body 450, and fitting structure 422 associated with fastener cartridge 455. It may be understood that guide structure 416 and fitting structure 422 may be physically coupled and decoupled in order to attach and detach, respectively, fastener cartridge 455 and gun body 450. While guide structure 416 is depicted as being arranged on gun body 450 and fitting structure 422 is depicted as being arranged on fastener body 455, in other examples guide structure 416 may be arranged on fastener body 455 and fitting structure 422 may be arranged on gun body 450, without departing from the scope of this disclosure. The guide structure may comprise a female-type connector or connectors while the fitting structure may comprise a male-type connector or connectors, in some examples. In alternative examples, the fitting structure may comprise a female connector or connectors while the guide structure may comprise a male connector or connectors. As one example, the guide structure may be one of a dovetail and a dovetail groove, and the fitting structure may be the other of the dovetail and the dovetail groove. As another example, the guide structure may be one of a tenon and a mortise, and the fitting structure may be the other of the tenon and the mortise. As another example, the guide structure may be one of a convex block or blocks and a groove or grooves, and the fitting structure may be the other of the convex block or blocks and the groove or grooves.

Thus, it may be understood that nail gun 400 enables fastener cartridges to be readily changed by detaching a particular fastener cartridge 455 from gun body 450 and then attaching another particular fastener cartridge 455 to gun body 450. It may be understood that particular fastener cartridges 455 may include in some examples different fasteners (e.g., one nail-type fastener and one staple-type fastener), that can still each be used with a same gun body 450. In other words, gun body 450 may accept a variety of fastener cartridges 455 storing different fastener types. In this way, the same gun body 450 can be used, for example, to drive nails into a medium in one example and staples into a medium in another example, without compromising operational effectiveness and by simply swapping out fastener cartridges.

FIG. 49 is presented as a representative example to illustrate particular relevant aspects of a modular fastener gun of the present disclosure that enables a single gun body 450 to accept and work functionally with any number of different fastener cartridges 455. However, not all aspects of FIG. 49 are present in each and every embodiment discussed herein, and the structural makeup of each different embodiment is elaborated infra.

Embodiment 1

Figure 2:
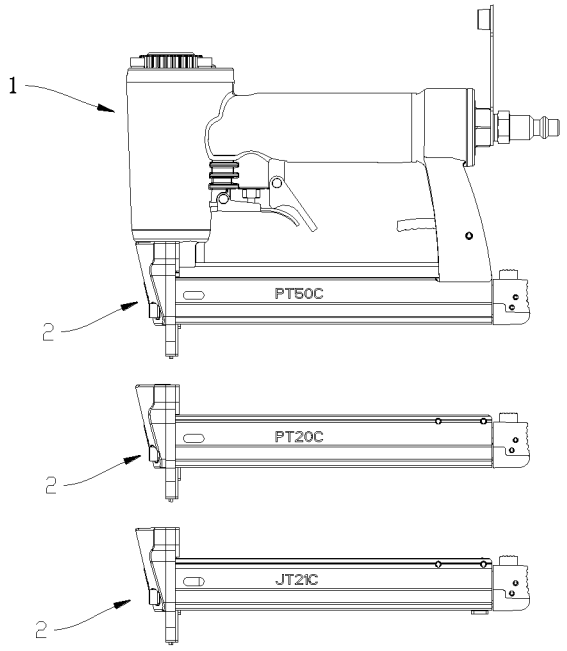
FIG. 2 is a schematic structural front view of a fastener gun according to Embodiment 1 of the present disclosure.
Figure 3:
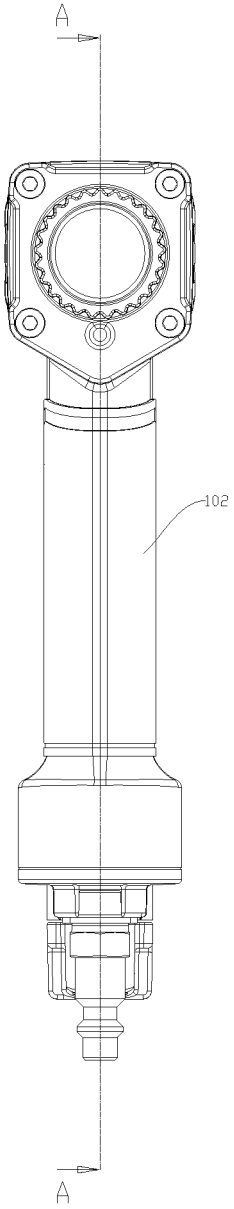
FIG. 3 is a schematic structural top view of a fastener gun according to Embodiment 1 of the present disclosure.

As shown in FIGS. 1 and 2, the structure of a fastener gun 100 mainly comprises a gun body 1 and a fastener box component 2. The gun body 1 is used to install the fastener box component 2. The fastener box component 2 is used to accommodate fasteners and transfer a fastener, so that the fastener gun 100 fastens the fastener at a desired position. In the present disclosure, each gun body 1 is equipped with a plurality of fastener box components 2. Each fastener box component 2 holds fasteners of at least one specification. The plurality of fastener box components 2 are respectively connected to one same gun body 1 in the same connection manner. That is, the fastener box component 2 installed on the gun body 1 is replaceable. Three fastener box components 2 are shown in the figure. The three fastener box components 2 may all be respectively connected to the gun body 1. The plurality of fastener box components 2 may hold same fasteners or may hold different fasteners. The same fastener box component 2 may hold one type of fasteners or may hold a plurality of fasteners.

The conventional structure and shape of the gun body 1 may be determined according to an actual use requirement.

In this embodiment, the fastener gun 100 is described by using the structure of a pneumatic staple gun as an example.

As shown in FIG. 1 and FIGS. 4 to 7, the gun body 1 comprises a connecting portion 101, a grasping portion 102, a driving portion 103, and a crossbeam 109. An upper end of the connecting portion 101 and an upper end of the driving portion 103 are respectively connected to two ends of the grasping portion 102. A lower end of the connecting portion 101 is used to be connected to the crossbeam 109 and the fastener box component 2. The connecting portion 101 is used to be connected to the fastener box component 2 and help stabilize the fastener box component 2. The grasping portion 102 is used to be grasped by an operator. In addition, the grasping portion 102 is further used to store gas for power. The driving portion 103 is used to provide a driving structure required for fastening. The crossbeam 109 is used to support the fastener box component 2 and is used to guide the fastener box component 2 during installation and disassembly thereof. The lower end of the connecting portion 101 is provided with a first notch 104. A first pin shaft 105 (see FIG. 8) is installed in the first notch 104. The lower end of the connecting portion 101 and a lower end of the driving portion 103 are respectively connected to two ends of the crossbeam 109. The connecting portion 101, the grasping portion 102, and the driving portion 103 are integrally molded. The two ends of the crossbeam 109 are respectively detachably connected to the connecting portion 101 and the driving portion 103. A detachable connection manner may be implemented by using a conventional measure such as a fastening piece.

Figure 4:
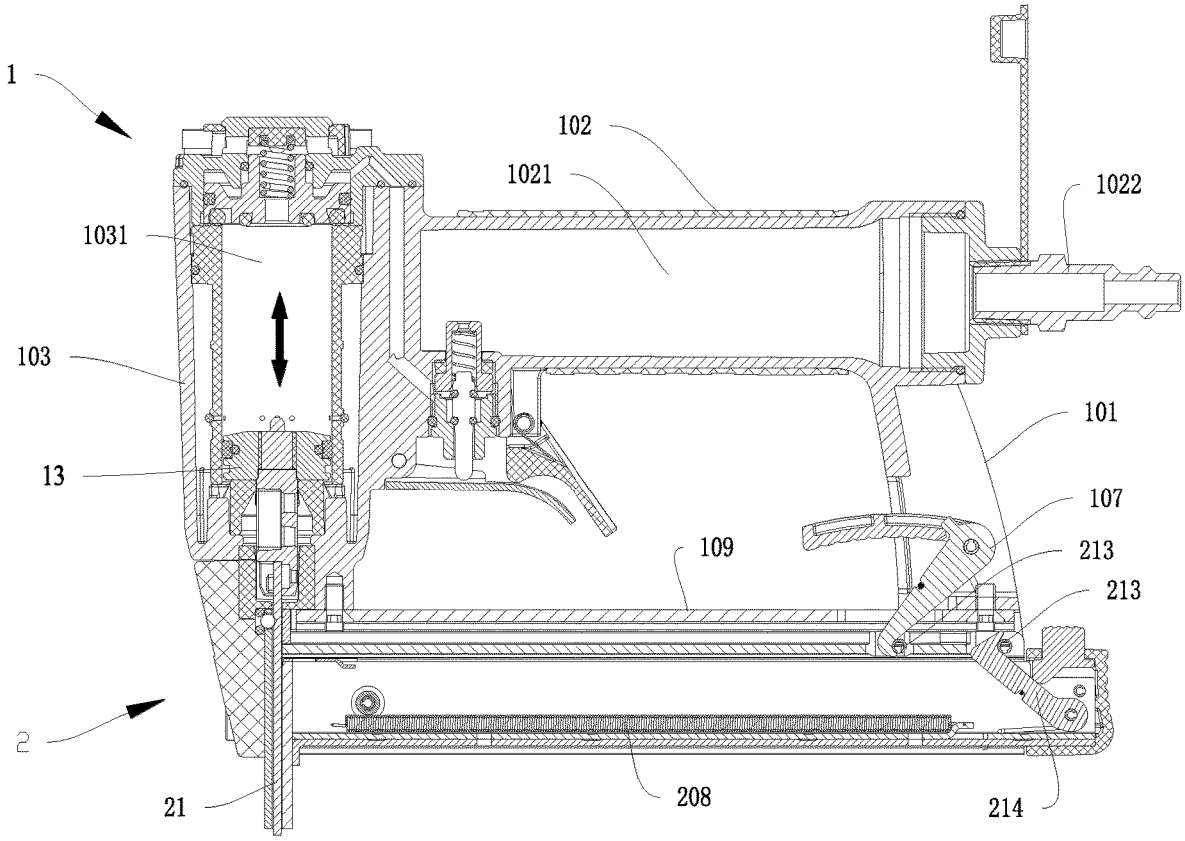
FIG. 4 is a cross-sectional view along an axis defined as A-A in FIG. 3.
Figure 5:
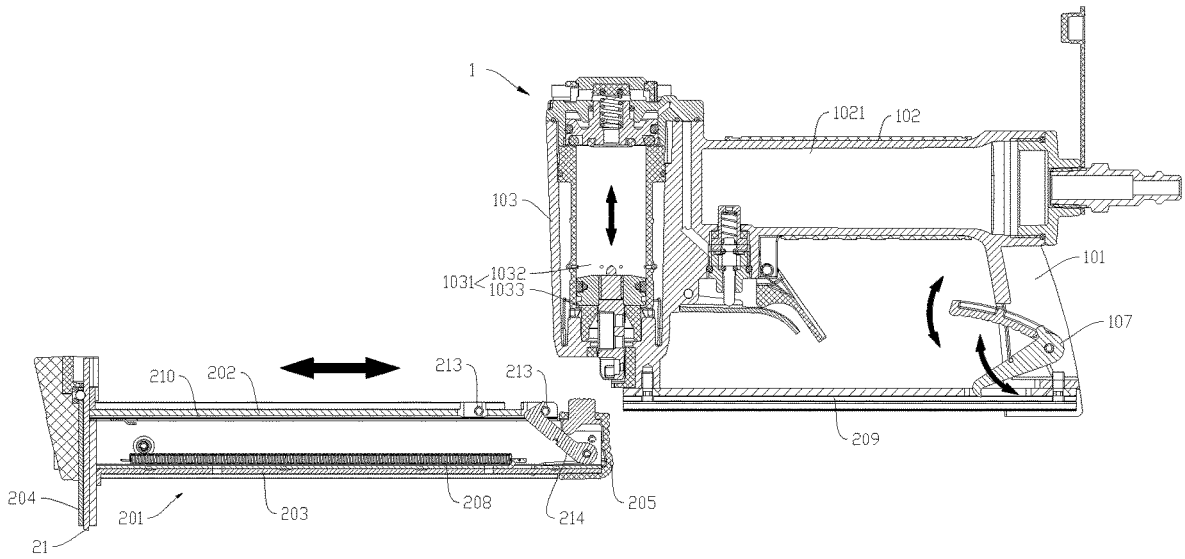
FIG. 5 is schematic cross-sectional view of a gun body of a fastener gun being separate from a fastener box component according to Embodiment 1 of the present disclosure.

As shown in FIGS. 4 and 5, one end of the grasping portion 102 is connected to the upper end of the connecting portion 101, and the other end is connected to the upper end of the driving portion 103. The grasping portion 102 is provided with a gas storage cavity 1021. The grasping portion 102 is provided with an air inlet tube 1022. The air inlet tube 1022 is in communication with the gas storage cavity 1021 and is used to supply gas to the gas storage cavity 1021.

The driving portion 103 has a set length and is used to install a driving structure such as a power member 13 required for fastening (e.g., driving a fastener into a medium). The driving portion 103 is provided with a stroke cavity 1031. The stroke cavity 1031 is used to provide the power member 13 with a space required for a stroke. In the example shown in the figure, the shape of the driving portion 103 is approximately circular. The stroke cavity 1031 extends in a vertical direction by a chosen height. The power member 13 is provided in the stroke cavity 1031. The power member 13 is movable in the stroke cavity 1031. The power member 13 has a shape matching that of the stroke cavity 1031, and divides the stroke cavity 1031 into an upper part and a lower part, that is, an upper cavity 1032 and a lower cavity 1033. The upper cavity 1032 and the lower cavity 1033 are respectively in communication with the gas storage cavity 1021. A valve may be used to control power air in the gas storage cavity 1021 to enter the upper cavity 1032 or the lower cavity 1033. The power air enters the upper cavity 1032 to drive the power member 13 to move downward for fastening. The power air enters the lower cavity 1033 to drive the power member 13 to move upward to enable a fastening member 21 to move out of a fastening channel 216 to enable a staple 200 to enter the fastening channel 216 (see FIG. 15). The lower end of the driving portion 103 is provided with a first pin post 1034 (see FIG. 6). The first pin post 1034 extends away from the connecting portion 101. In the example shown in the figure, there are two first pin posts 1034. The two first pin posts 1034 are arranged at intervals.

Figure 6:
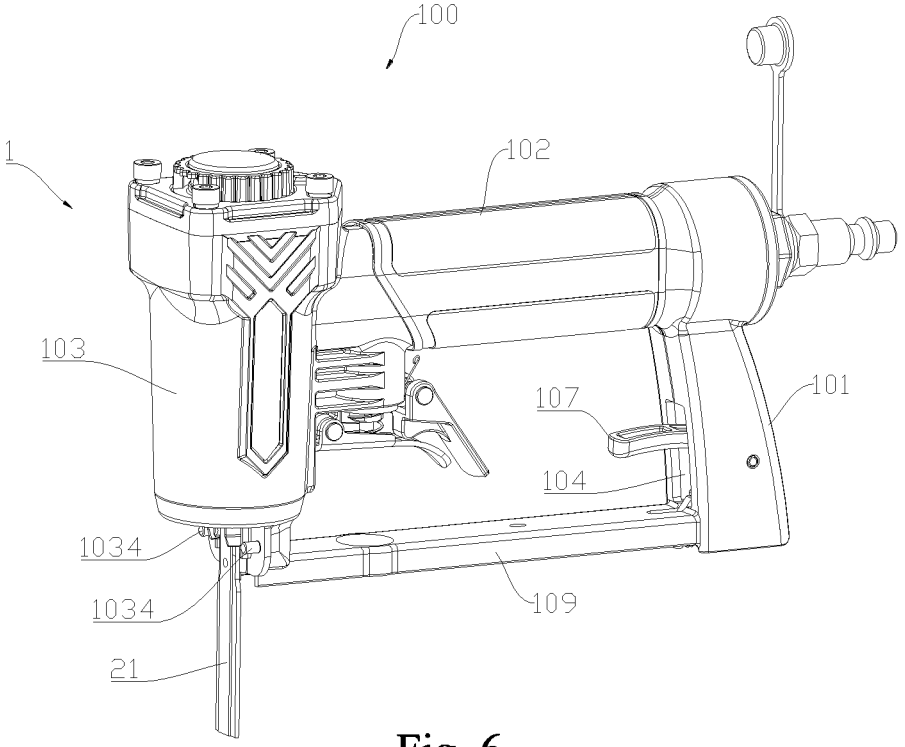
FIG. 6 is a schematic structural diagram of a gun body according to Embodiment 1 of the present disclosure.
Figure 7:
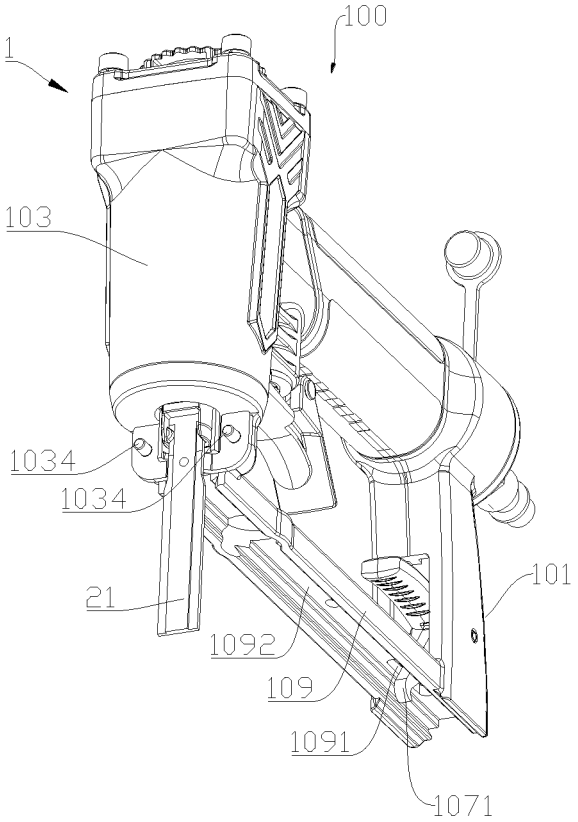
FIG. 7 is a schematic structural diagram of a gun body viewed from another angle according to Embodiment 1 of the present disclosure.
Figure 8:
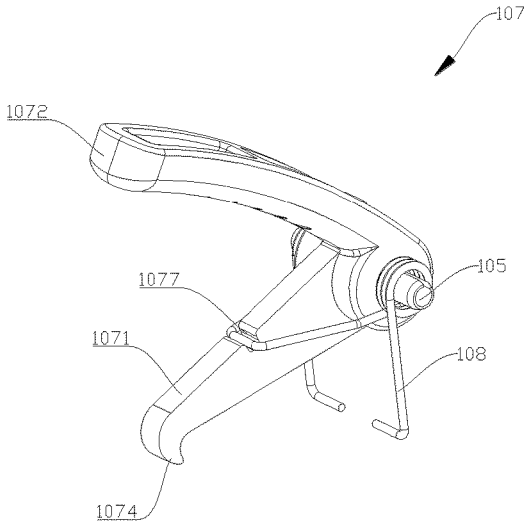
FIG. 8 is a schematic structural diagram of a first locking hook according to the present disclosure.
Figure 9:
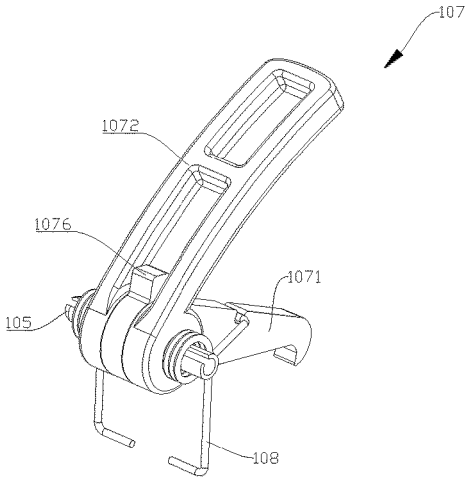
FIG. 9 is a schematic structural diagram of a first locking hook viewed from another angle according to the present disclosure.
Figure 10:
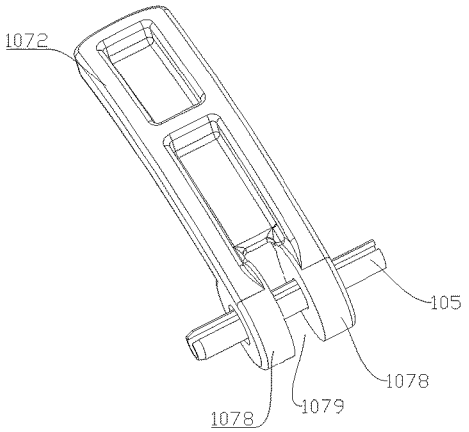
FIG. 10 is a schematic diagram of the structure and installation of a handgrip according to Embodiment 1 of the present disclosure.
Figure 11:
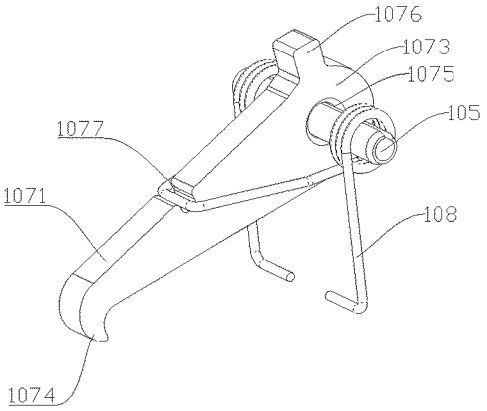
FIG. 11 is a schematic diagram of the structure and installation of a hanging hook according to Embodiment 1 of the present disclosure.

As shown in FIGS. 6 and 7, the gun body 1 further comprises a crossbeam 109. The crossbeam 109 is provided with a second through hole 1091. The second through hole 1091 penetrates the crossbeam 109 from top to bottom. The second through hole 1091 provide a hanging hook 1071 of a first locking hook 107 with a movement channel, to enable the hanging hook 1071 to rotate to pass through the crossbeam 109 from inside the second through hole 1091. A lower surface of the crossbeam 109 is further provided with a third groove 1092. The two ends of the crossbeam 109 are respectively detachably connected to the lower end of the connecting portion 101 and the lower end of the driving portion 103.

As shown in FIG. 1 and FIGS. 8 to 11, the first pin shaft 105 is sleeved with a rotatable first locking hook 107 (see FIGS. 4-6). The first locking hook 107 may rotate around the first pin shaft 105. The first locking hook 107 generally has a V shape, with the structure thereof comprising a hanging hook 1071 and a handgrip 1072. One end of the hanging hook 1071 is provided with an installation disk 1073, and the other end is provided with a hook body 1074. The installation disk 1073 is provided with a first through hole 1075. The installation disk 1073 is further provided with a convex block 1076. The convex block 1076 is arranged protruding from the installation disk 1073. A fifth groove 1077 is provided in the middle of the hanging hook 1071. An end of the handgrip 1072 is provided with a notch 1079. Two sides of the notch 1079 are a gripping portion 1078. The installation disk 1073 is located between two gripping portions 1078. The first pin shaft 105 passes through the gripping portions 1078 and the installation disk 1073. The convex block 1076 extends from between the two gripping portions 1078 and is lapped over the handgrip 1072. The hanging hook 1071 and the handgrip 1072 are relatively rotatable. The convex block 1076 is lapped over the handgrip 1072 to restrict an angle by which the hanging hook 1071 rotates relative to the handgrip 1072. The first locking hook 107 is installed on the connecting portion 101 rotatably around the first pin shaft 105. The first pin shaft 105 is further sleeved with a first torsion spring 108. Two ends of the first torsion spring 108 are fastened, with the middle thereof is lapped on the fifth groove 1077 in the middle of the hanging hook 1071. A torque direction of the first torsion spring 108 is opposite the direction in which the hanging hook 1071 rotates when being pushed by the handgrip 1072. As shown in FIG. 5, the first locking hook 107 hooks a pin shaft 213 such that the fastener box component 2 is connected to the connecting portion 101. If the fastener box component 2 needs to be disassembled, it is only necessary to hold the handgrip 1072 with a hand to drive the hanging hook 1071 to rotate clockwise. The handgrip 1072 needs to overcome the torque of the first torsion spring 108 to push the hanging hook 1071 to rotate clockwise. In this case, the first torsion spring 108 deforms to generate torque. The torque of the first torsion spring 108 may enable the hanging hook 1071 to reset and help keep the hanging hook 1071 at a desired position. In the state shown in FIG. 5, the handgrip 1072 is rotatable relative to the hanging hook 1071. Therefore, when the hanging hook 1071 hooks the pin shaft 213, the handgrip 1072 may rotate counterclockwise to be lapped over the crossbeam 109. In this way, a worker may hold the grasping portion 102 with a hand to prevent the handgrip 1072 from hindering the hand.

Figure 12:
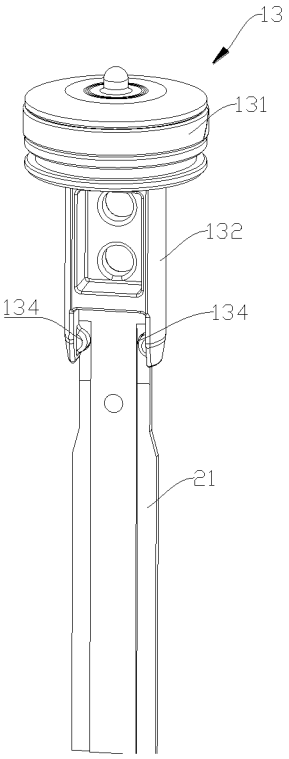
FIG. 12 is a schematic structural diagram of a power member and a fastening member being in a connected state according to Embodiment 1 of the present disclosure.
Figure 13:
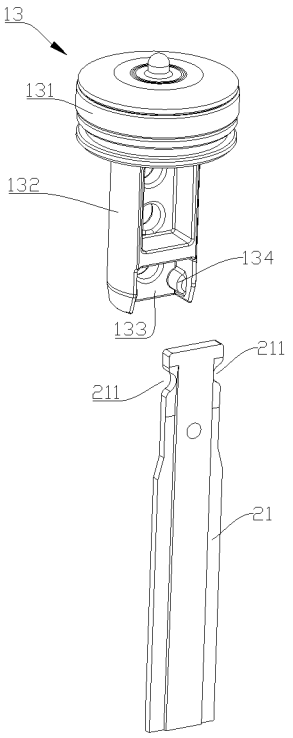
FIG. 13 is a schematic structural diagram of a power member and a fastening member being in a detached state according to Embodiment 1 of the present disclosure.

As shown in FIGS. 12 and 13, the power member 13 fits with the stroke cavity 1031 in structure and shape, and is suitable for being driven by power air to move in the stroke cavity 1031. In the example shown in FIGS. 12-13, the power member 13 has a circular force bearing disk 131 and an installation base 132. The force bearing disk 131 and the installation base 132 are connected, and are preferably integrally molded. A lower end of the installation base 132 is provided with an installation groove 133. A convex post 134 is provided in the installation groove 133. The convex post 134 is used to be connected to the following fastening member 21. In the example shown in the figure, there are two convex posts 134, each having a semicircular shape. The two convex posts 134 protrude toward each other. The convex post 134 is used to fit with a notch 211 in the fastening member 21 such that the installation base 132 is connected to the fastening member 21.

As shown in FIG. 14 to FIGS. 16A, 16B, 16C, and 16D, the fastener box component 2 comprises a fastener box. The fastener box comprise a base 201 (see FIG. 5) and a fastener accommodating box 202. The base 201 comprises a bottom plate 203, a first connecting base 204, and a second connecting base 205. The first connecting base 204 and the second connecting base 205 are connected to two ends of the bottom plate 203, and protrude upward from the bottom plate 203. The first connecting base 204 is provided with a first pin hole 215. The first pin hole 215 is used to fit with the first pin post 1034 (see FIG. 7). The first pin post 1034 is plugged in the first pin hole 215 such that the first connecting base 204 is connected to the driving portion 103. The first connecting base 204 is further provided with a fastening channel 216 (see FIG. 15). The fastening channel 216 penetrates the first connecting base 204 from top to bottom and is used to provide a channel for launching the staple 200. The fastening channel 216 is installed in the fastening member 21 (see FIG. 14). The fastening member 21 is used to be connected to the power member 13 and is driven by the power member 13 to move to launch the staple 200. In the example shown in the figure, the fastening member 21 is plate form. An upper end of the fastening member 21 is provided with two notches 211 (see FIG. 13). The shape of the notch 211 fits with that of the convex post 134. The surface of the fastening member 21 is provided with a recess 217 (see FIG. 16D). The first connecting base 204 is connected to an installation plate 218. The installation plate 218 is provided with a third through hole 2181. A ball 219 is provided between the installation plate 218 and the first connecting base 204. The ball 219 is arranged opposite the third through hole 2181, and the ball 219 may partially pass through the third through hole 2181 to protrude from the installation plate 218. An elastic O-shaped ring 2191 is provided between the ball 219 and the first connecting base 204. The ball 219 is compressed to press the elastic O-shaped ring 2191. The elastic O-shaped ring 2191 is compressed to deform to enable the ball 219 to retract into the third through hole 2181. The ball 219 protrudes from the installation plate 218 to be embedded in the recess 217 of the fastening member 21 to restrict the fastening member 21 at this position. The fastening member 21 presses the ball 219 under the effect of a force, to enable the ball 219 to retract into the third through hole 2181, thereby releasing the restriction on the fastening member 21.

Figure 16A:
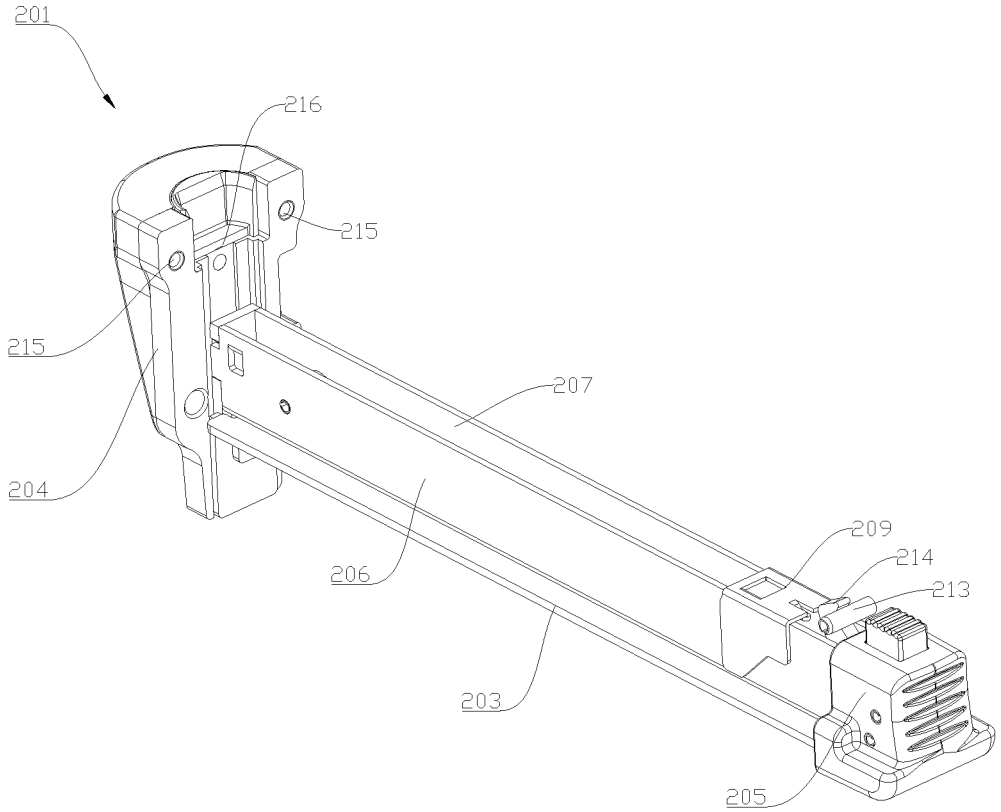
FIG. 16A is a schematic structural diagram of a base according to the present disclosure.
Figure 16B:
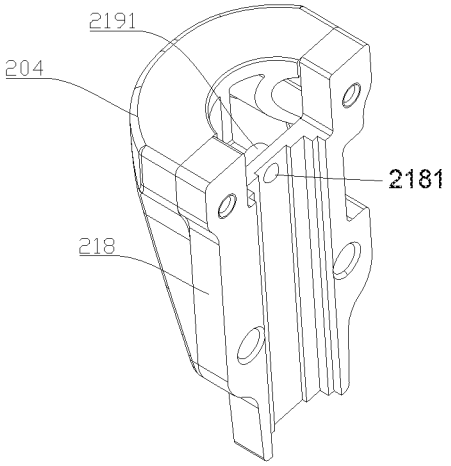
FIG. 16B is a schematic diagram of the connection relationship between a first connecting base and a fastening member according to the present disclosure.
Figure 16C:
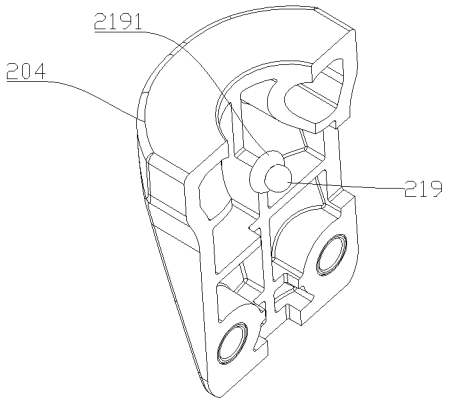
FIG. 16C is a schematic diagram of the fitting relationship between a first connecting base and a ball according to the present disclosure.
Figure 16D:
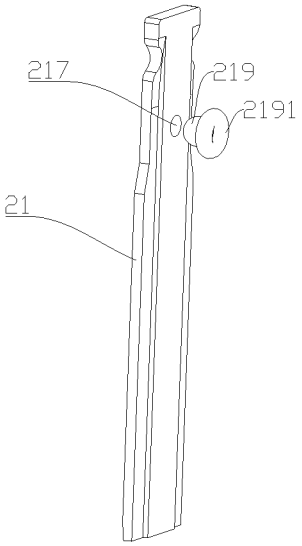
FIG. 16D is a schematic diagram of the fitting relationship between a ball and a fastening member according to the present disclosure.

The bottom plate 203 is provided with a guide rail 206. The guide rail 206 is used to support a staple 200. A plurality of staples 200 are arranged on the guide rail 206 and are movable along the guide rail 206 (FIG. 16A). The guide rail 206 is provided with an accommodating groove 207. The guide rail 206 is provided with a nail pushing piece 209. The fastener pushing piece 209 movably spans the guide rail 206 and is movable along the guide rail 206. The fastener pushing piece 209 moves along the guide rail 206 to push the staple 200 to move, to sequentially push the staple 200 into the fastening channel 216. The accommodating groove 207 is provided with a fourth spring 208, also referred to herein as a fourth elastic reset device (see FIG. 5). One end of the fourth spring 208 is fastened, and the other end is connected to the fastener pushing piece 209. The fourth spring 208 be elastically deformable to possess an elastic force. The elastic force may drive the fastener pushing piece 209 to move. A first hanging hook 214 is further provided in the accommodating groove 207. The first hanging hook 214 is configured to swing. One end of the first hanging hook 214 is rotatably connected to the accommodating groove 207, and the other end is freely arranged.

A sectional surface of the fastener accommodating box 202 has an approximate U shape. An outer surface of the fastener accommodating box 202 is provided with a convex block 271 (see FIG. 14). The shape of the convex block 271 fits with that of the third groove 1092. The convex block 271 may be plugged in the third groove 1092 and is movable in the third groove 1092 (see FIG. 7). An end portion of the convex block 271 is provided with a sixth groove 212. Two pin shafts 213 are provided in the sixth groove 212. One of the pin shafts 213 is used to fit with the hanging hook 1071 to hook the hanging hook 1071. The other pin shaft 213 is used to fit with the first hanging hook 214 to hook the first hanging hook 214 (see FIG. 5). The first hanging hook 214 may further be kept at a desired position by using an elastic device such as a torsion spring. For this structure, reference may be to the foregoing first torsion spring 108. Details are not described herein again.

The fastener accommodating box 202 is buckled on the bottom plate 203 and is located between the first connecting base 204 and the second connecting base 205. Two ends of the fastener accommodating box 202 are respectively connected to the first connecting base 204 and the second connecting base 205. A connection manner of such a connection may be a conventional mechanical connection manner such as a fastening piece. The first hanging hook 214 hooks one of the pin shafts 213 such that the base 201 is connected to the fastener accommodating box 202. The fastener accommodating box 202, the bottom plate 203, the first connecting base 204, and the second connecting base 205 define a fastener accommodating cavity 210. The fastener accommodating box 202 restricts the fastener pushing piece 209 to be located in the fastener accommodating cavity 210 and only move along the guide rail 206.

As shown in FIG. 5, when the fastener box component 2 is installed on the gun body 1, one end of the fastener box component 2 is detachably connected through the fitting between the first pin post 1034 and the first pin hole 215, and the other end is detachably connected through the fitting between the hanging hook 1071 and the pin shaft 213. Specifically, the fastener box component 2 moves from bottom to top until the convex block 271 is plugged in the third groove 1092. The first connecting base 204 is located on a left side of the first pin post 1034. The convex block 271 may move transversely in the third groove 1092. The first pin post 1034 is aligned with the first pin hole 215. The fastener box component 2 is pushed from left to right until the first pin post 1034 is plugged in the first pin hole 215 such that the first connecting base 204 is detachably connected to the driving portion 103. The upper end of the fastening member 21 enters the installation groove 133. The two convex posts 134 are respectively embedded in one notch 211 from two sides such that the fastening member 21 is connected to the installation base 132. The two convex posts 134 grip the fastening member 21. The hanging hook 1071 hooks the pin shaft 213 such that the fastener accommodating box 202 is connected to the connecting portion 101. The first torsion spring 108 applies a force to the hanging hook 1071 to keep the hanging hook 1071 in a state of hooking the pin shaft 213. During disassembly, the handgrip 1072 is triggered to enable the first locking hook 107 to generally rotate, and the hanging hook 1071 rotates to unhook the pin shaft 213. The fastener box component 2 is pushed from right to left to enable a first base 240 to move off the first pin post 1034. That is, the first pin post 1034 exits the first pin hole 215. The fastener box component 2 moves downward to enable the convex block 271 to exit the third groove 1092, so that the fastener box component 2 may be detached from the gun body 1.

According to the present disclosure, the plurality of fastener box components 2 may be configured to be detachably connected to one same gun body 1. Each fastener box component 2 holds staples 200 of one specification. By means of replacing the fastener box components 2, staples 200 of different specifications can be launched.

In this embodiment, a connecting piece is the first pin post 1034, and a first alignment structure is the first pin hole 215. A locking piece is a first locking hook 107, and a second alignment structure is a pin shaft 213. A guide structure is a third groove 1092, and a fitting structure is a convex block 271. As shown in FIG. 5, the fastener box component 2 is installed on the gun body 1 facing the right. The fastener box component 2 moves to the left to be detached from the gun body 1. When the fastener box component 2 is installed on the gun body 1, the first locking hook 107 hooks on the pin shaft 213 to restrict the fastener box component 2 from moving to the left to be detached from the gun body 1. The first torsion spring 108 is an embodiment of a sixth elastic reset device. According to the structure of the first locking hook 107, the first torsion spring 108 may further be replaced with a component having the same or similar function.

"Up", "down", "left", and "right" in this embodiment are used for clear description of this embodiment. Refer to FIG. 5 for the used relative concept.

Embodiment 2

Figure 17:
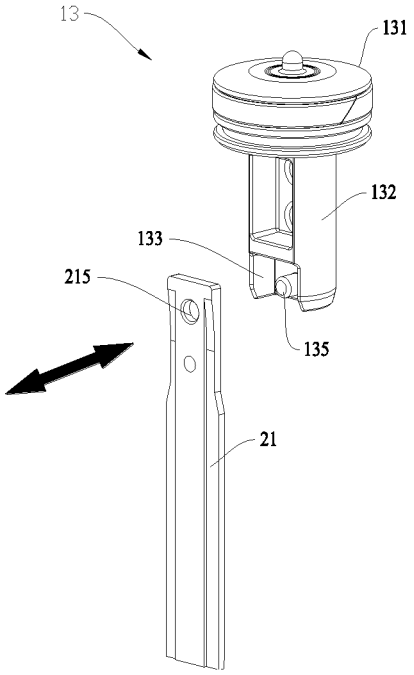
FIG. 17 is a schematic structural diagram of the connection between a power member and a fastening member according to Embodiment 2 of the present disclosure.

As shown in FIG. 17, a difference between this embodiment and Embodiment 1 lies in a different connection manner between the power member 13 and the fastening member 21. A third pin post 135 is provided in the installation groove 133. A second pin hole 2110 is provided in the fastening member 21. The third pin post 135 is plugged in the second pin hole 2110, and the fastening member 21 is hung on the power member 13. Reference may be made to the arrow shown in the figure for the installation and disassembly of the fastening member 21.

For the structure described in this embodiment, the foregoing embodiment and a conventional structure may be used.

Embodiment 3

Figure 18:
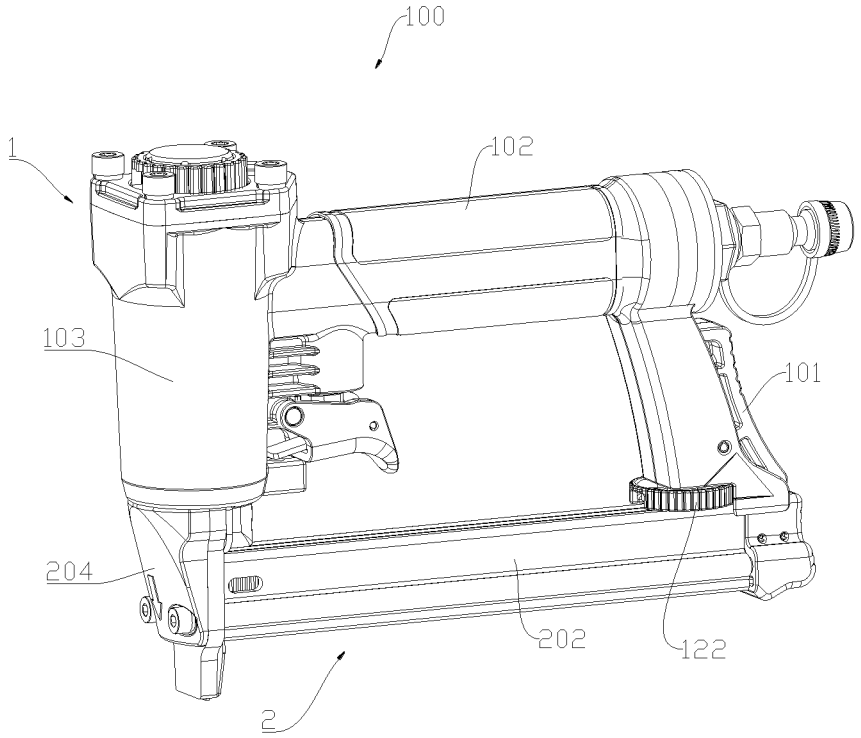
FIG. 18 is a schematic structural diagram of a fastener gun according to Embodiment 3 of the present disclosure.
Figure 19:
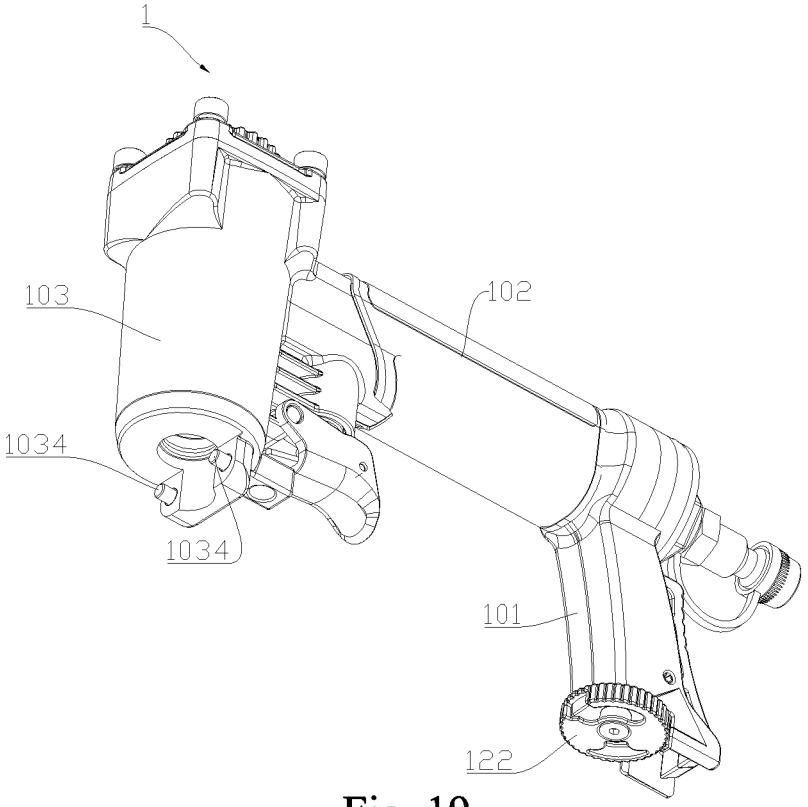
FIG. 19 is a schematic structural diagram of a gun body according to Embodiment 3 of the present disclosure.

As shown in FIG. 18, in this embodiment, the fastener gun 100 comprises a gun body 1 and a fastener box component 2. A difference between this embodiment and Embodiment 1 lies in that a crossbeam 209 is not arranged on the gun body 1. The connecting portion 101, the grasping portion 102, and the driving portion 103 are arranged in an inverted U shape.

A connection manner between the driving portion 103 and the first connecting base 204 is the same as that in Embodiment 1. The first pin hole 215 fits with the first pin post 1034 to implement a connection.

As shown in FIG. 18, FIG. 19 and FIGS. 21-22, the lower end of the connecting portion 101 is provided with a knob 122. The knob 122 is provided with an accommodating cavity 1221. The knob 122 is provided with an inlet 1223. The inlet 1223 is in communication with the accommodating cavity 1221. A lower bottom plate 1222 of the knob 122 is provided with a curved groove 1224. The curved groove 1224 penetrates the lower bottom plate 1222. The knob 122 is rotatably installed at the lower end of the connecting portion 101.

Figure 20:
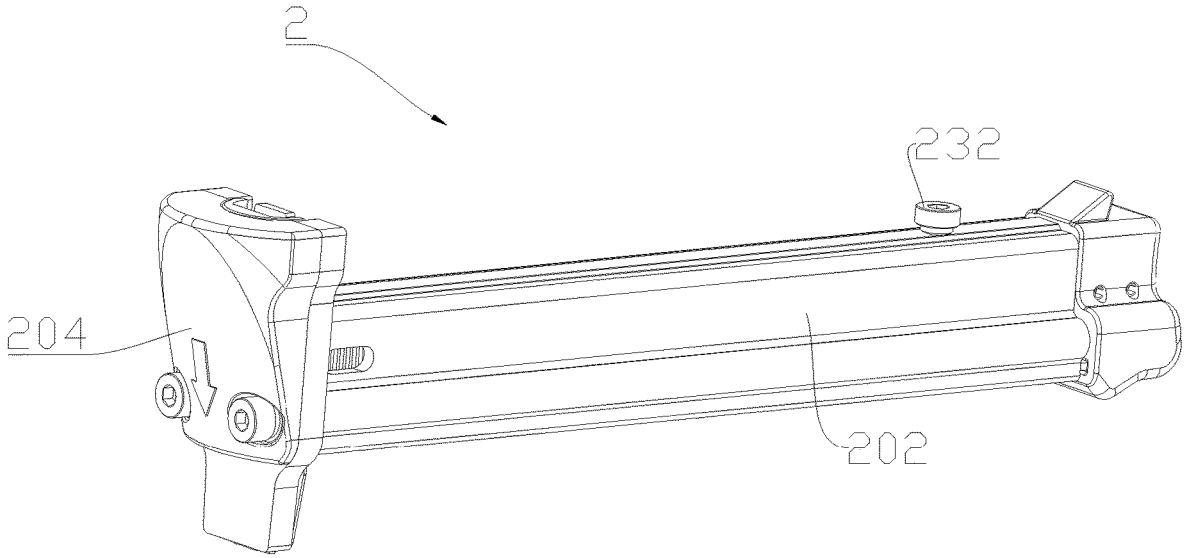
FIG. 20 is a schematic structural diagram of a fastener box component according to Embodiment 3 of the present disclosure.

As shown in FIG. 20, the fastener accommodating box 202 is provided with a pin 232. The structure of the pin 232 comprises a pin body 233 and a pin cap 234. The size of the pin cap 234 is greater than that of the pin body 233. The pin cap 234 is connected to the pin body 233 and protrudes from the pin body 233. The pin body 233 is fixedly connected to the fastener accommodating box 202 and protrudes from the fastener accommodating box 202. The pin cap 234 is arranged at an end portion of the pin body 233, and is at a gap from the fastener accommodating box 202. The size of the pin 232 is set as follows: The pin cap 234 may enter and move out of the accommodating cavity 1221 through the inlet 1223, but cannot enter and move out of the accommodating cavity 1221 through the curved groove 1224. The pin body 233 may pass through the lower bottom plate 1222 from the curved groove 1224 and is movable in the curved groove 1224. After the pin cap 234 enters the accommodating cavity 1221, the lower bottom plate 1222 prevents the pin cap 234 from leaving the curved groove 1224.

Figure 21:
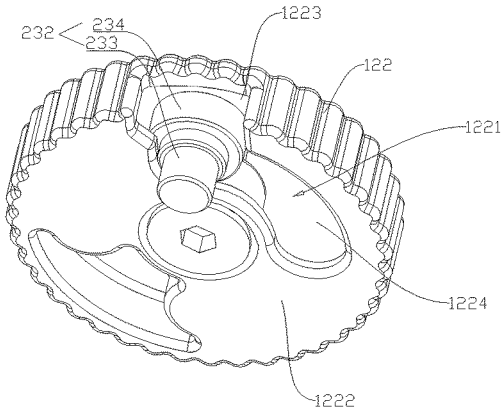
FIG. 21 is a schematic structural diagram of the fitting relationship between a knob and a pin according to Embodiment 3 of the present disclosure.
Figure 22:
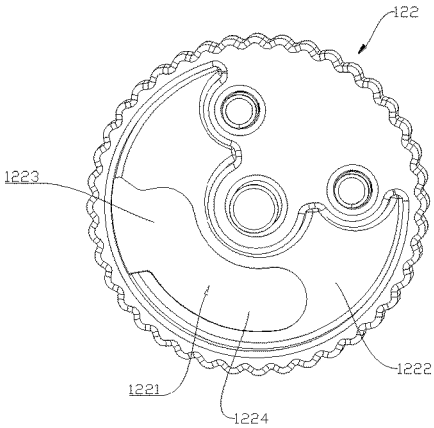
FIG. 22 is a schematic structural diagram of a knob according to Embodiment 3 of the present disclosure.

As shown in FIG. 21, the knob 122 fits with the pin 232 such that the knob 122 is connected to the pin 232. The lower bottom plate 1222 of the knob 122 is arranged facing the fastener accommodating box 202. During installation, the pin cap 234 of the pin 232 enters the accommodating cavity 1221 through the inlet 1223. The knob 122 is rotated, and the pin body 233 relatively moves in the curved groove 1224. The pin cap 234 is restricted in the accommodating cavity 1221 and cannot move out of. The pin cap 234 can move out of the accommodating cavity 1221 through the inlet 1223 only when the pin cap 234 is aligned with the inlet 1223, and the knob 122 is disconnected from the pin 232. Because the pin 232 cannot rotate, the pin 232 cannot be aligned the inlet 1223 without rotating the knob 122.

In this embodiment, the knob 122 fits with the pin 232 such that the fastener accommodating box 202 of the fastener box component 2 is detachably connected to the connecting portion 101.

For the structure described in this embodiment, the foregoing embodiment and a conventional structure may be used.

In this embodiment, a connecting piece is the first pin post 1034, and a first alignment structure is the first pin hole 215. A locking piece is the knob 122, and a second alignment structure is the pin 232. As shown in FIG. 18, the fastener box component 2 is installed on the gun body 1 facing the right. The fastener box component 2 moves to the left to be detached from the gun body 1. When the fastener box component 2 is installed on the gun body 1, the knob 122 hooks the pin 232 to restrict the fastener box component 2 from moving to the left to be detached from the gun body 1.

Embodiment 4

Figure 23A:
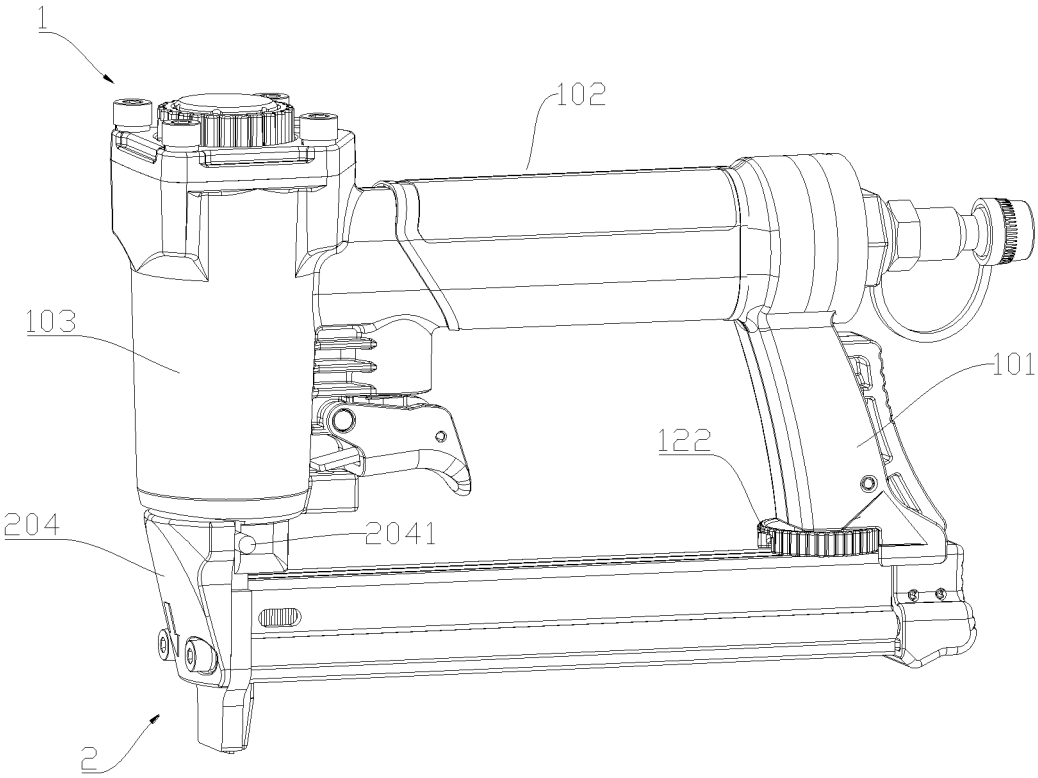
FIG. 23A is a schematic structural diagram of a fastener gun according to Embodiment 4 of the present disclosure.
Figure 23B:
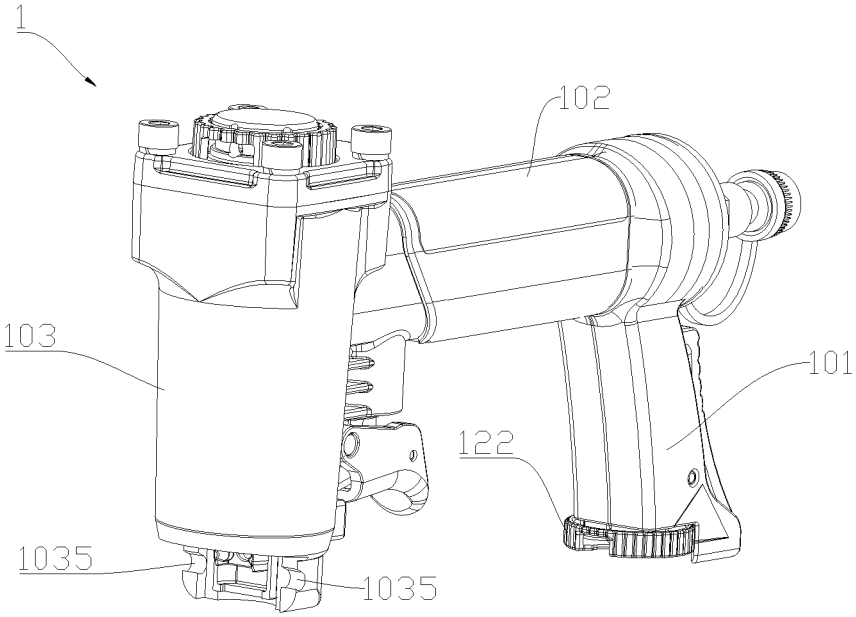
FIG. 23B is a schematic structural diagram of a gun body according to Embodiment 4 of the present disclosure.
Figure 23C:
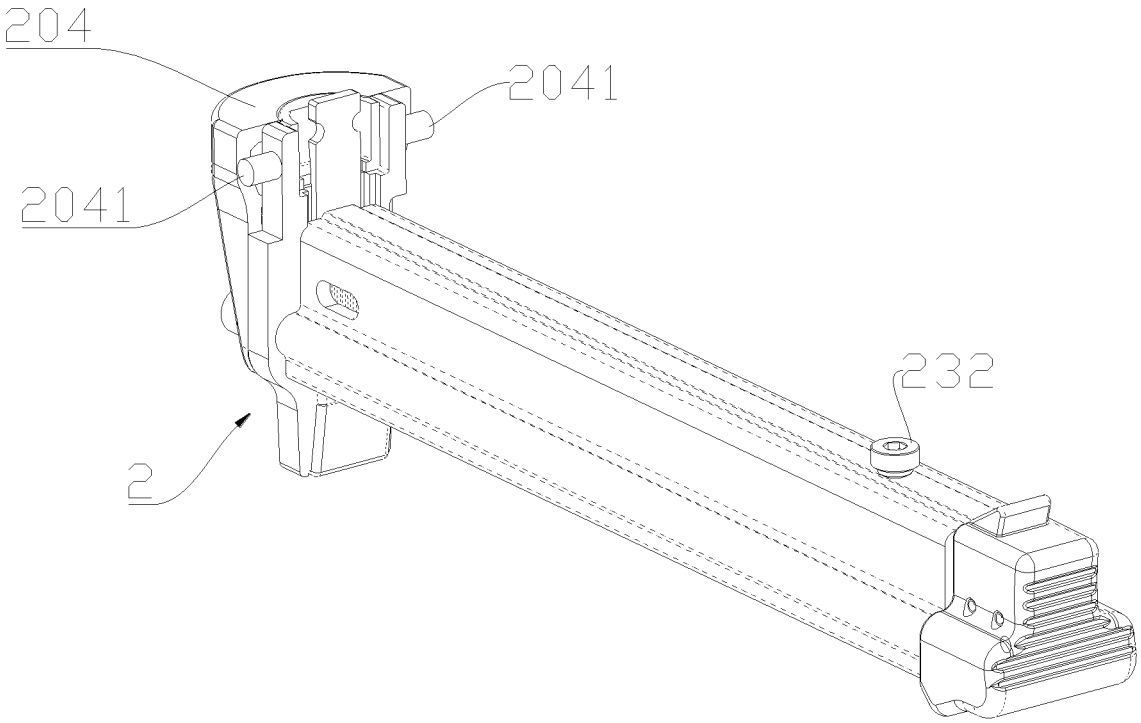
FIG. 23C is a schematic structural diagram of a fastener box component according to Embodiment 4 of the present disclosure.
Figure 24:
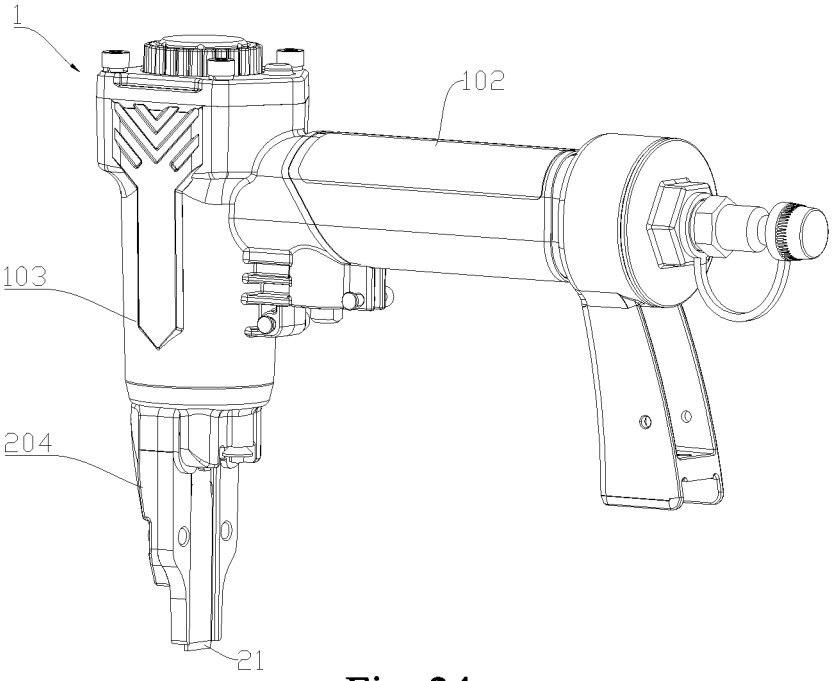
FIG. 24 is a partial schematic structural diagram of a fastener gun according to Embodiment 5 of the present disclosure.
Figure 25:
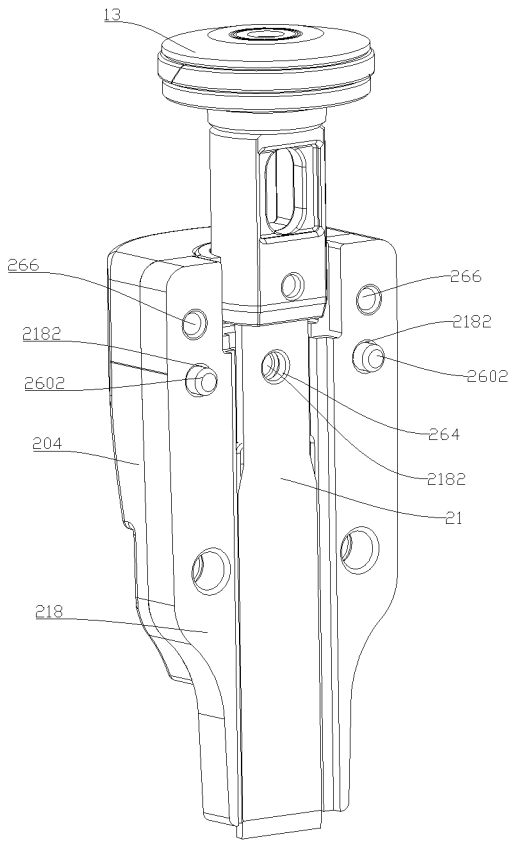
FIG. 25 is a schematic structural diagram of a first connecting base and a power member according to Embodiment 5 of the present disclosure.
Figure 26:
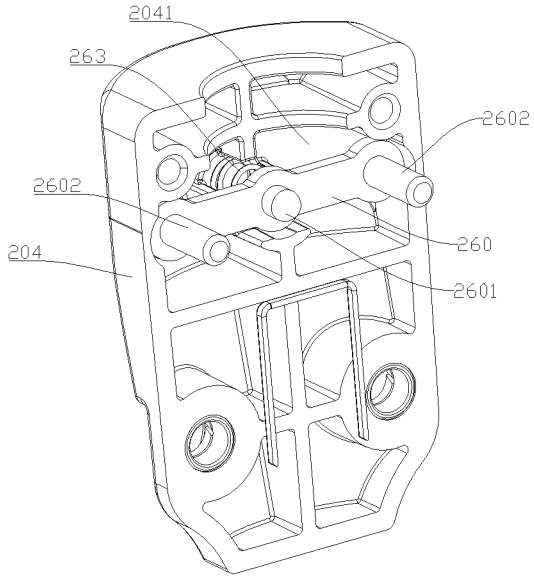
FIG. 26 is a partial schematic structural diagram of according to Embodiment 5 of the present disclosure.
Figure 27:
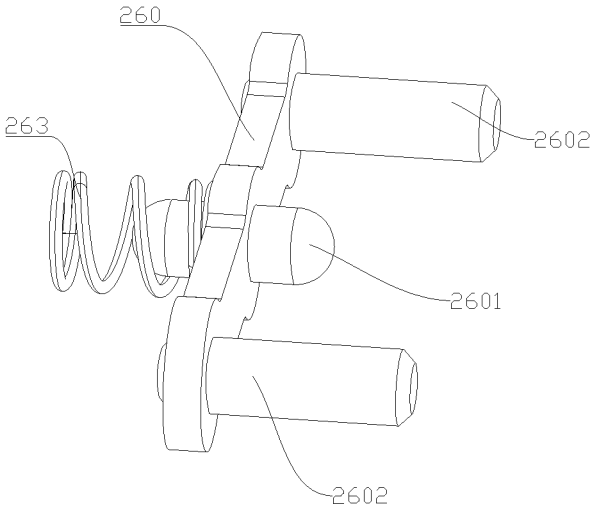
FIG. 27 is a schematic diagram of a fixing plate and a fitting structure thereof according to Embodiment 5 of the present disclosure.
Figure 28:
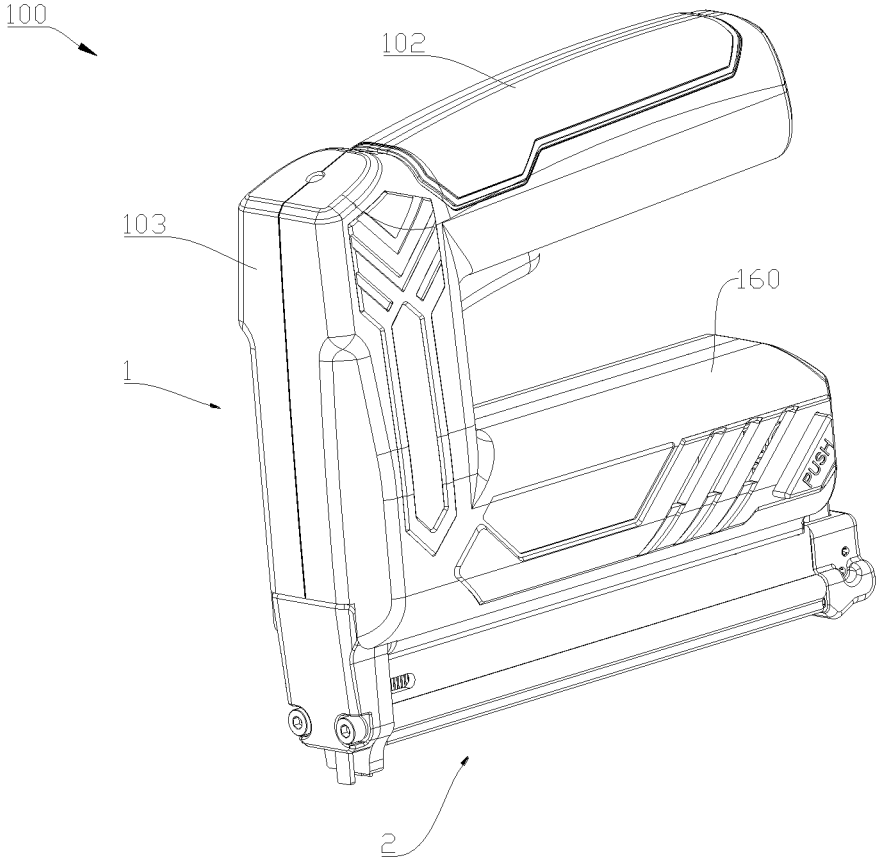
FIG. 28 is a schematic structural diagram of a fastener gun according to Embodiment 6 of the present disclosure.
Figure 29:
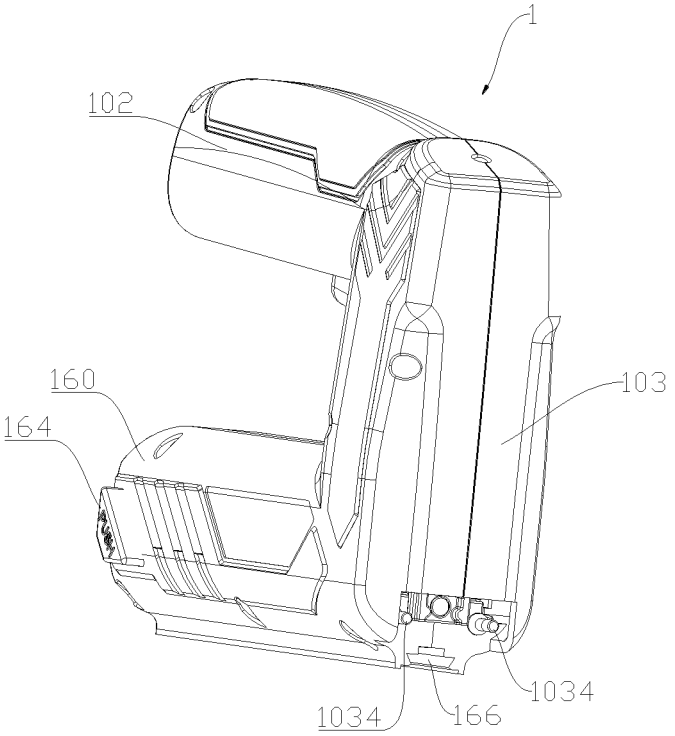
FIG. 29 is a schematic structural diagram of a gun body according to Embodiment 6 of the present disclosure.
Figure 30:
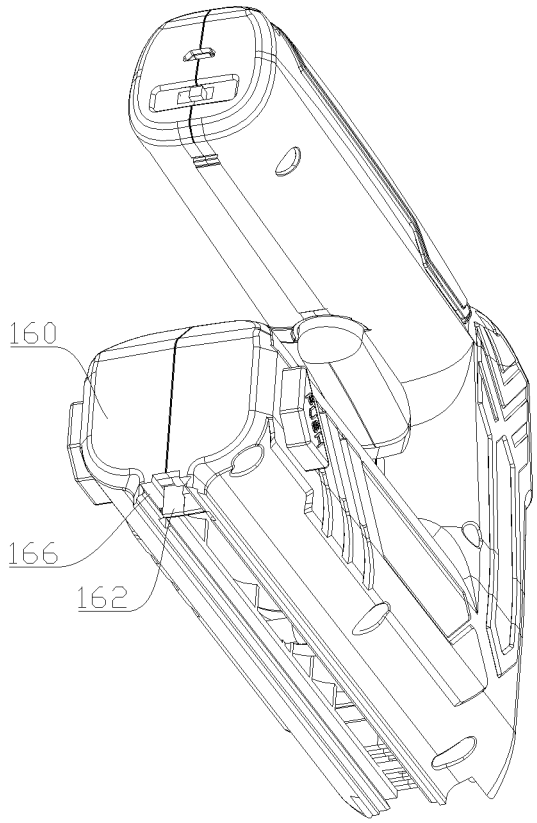
FIG. 30 is a schematic structural diagram of a gun body viewed from another angle according to Embodiment 6 of the present disclosure.

As shown in FIGS. 23A, 23B and 23C, a difference between this embodiment and Embodiment 3 lies in a different connection manner between the first connecting base 204 and the driving portion 103. In this embodiment, the first connecting base 204 is provided with a second pin post 2041. The second pin post 2041 is a circular post. The second pin post 2041 extends in a direction perpendicular to a movement direction of staples 200. The driving portion 103 is provided with a first groove 1035. The first groove 1035 is semicircular. The second pin post 2041 fits with the first groove 1035. The second pin post 2041 is placed in the first groove 1035 such that the first connecting base 204 is detachably connected to the driving portion 103.

A connecting piece in this embodiment is a second pin post 2041, and a first alignment structure is a first groove 1035. For the structure described in this embodiment, the foregoing embodiment and a conventional structure may be used.

Embodiment 5

As shown in FIG. 24 to FIG. 27, a connection manner between the fastening member 21 and the first connecting base 204 is different from that in the foregoing embodiment. The first connecting base 204 is provided with a seventh groove 2041. An installation plate 218 is installed on the first connecting base 204. The installation plate 218 closes the seventh groove 2041. The installation plate 218 is provided with three fourth through holes 2182. A fixing plate 260 is provided in the seventh groove 2041. The fixing plate 260 is movably arranged in the seventh groove 2041. Three shaft pins, that is, one major pin 2601 and two side pins 2602, are installed on the fixing plate 260. The major pin 2601 is arranged between the two side pins 2602. One major pin 2601 and the two sides pins 2602 respectively pass through one fourth through hole 2182 to protrude from the installation plate 218. A third spring 263 is provided between the major pin 2601 and the first connecting base 204. When the major pin 2601 is compressed, the third spring 263 may be pressed to enable the third spring 263 to contract, so that the length by which the major pin 2601 protrudes from the installation plate 218 is adjustable. The installation plate 218 is provided with a sixth through hole 266. The sixth through hole 266 is aligned with the first pin hole 215. The first pin post 1034 may pass through the sixth through hole 266 to enter the first pin hole 215. The fastening member 21 is provided with a fifth through hole 264. The fifth through hole 264 fits with the major pin 2601, and the major pin 2601 is plugged in the fifth through hole 264 such that the fixing plate 260 is connected to the fastening member 21.

When the first connecting base 204 is connected to the driving portion 103, as the first pin post 1034 is plugged in the first pin hole 215, the driving portion 103 abuts against the side pin 2602, and the side pin 2602 drives the fixing plate 260 and the major pin 2601 to move, to enable the major pin 2601 to exit from inside the fifth through hole 264. When the fastening member 21 has been connected to the installation base 132, the major pin 2601 completely exits from inside the fifth through hole 264. In this case, the fastening member 21 may move along the power member 13.

In this embodiment, the third spring 263 is a third elastic reset device. For the structure described in this embodiment, the foregoing embodiment and a conventional structure may be used.

Embodiment 6

As shown in FIG. 28 to FIG. 33, in this embodiment, the gun body 1 comprises a grasping portion 102, a driving portion 103, and a support portion 160. The grasping portion 102 and the support portion 160 are respectively connected to both ends of the driving portion 103, the three being distributed in a U shape. The fastener box component 2 is connected to the support portion 160.

Figure 31:
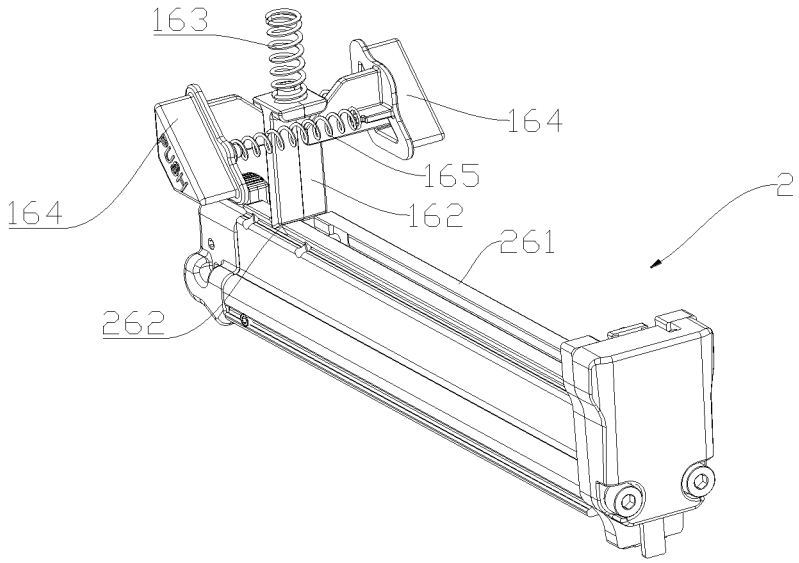
FIG. 31 is a schematic diagram of the fitting relationship between a sliding block and a fastener box component according to Embodiment 6 of the present disclosure.
Figure 32:
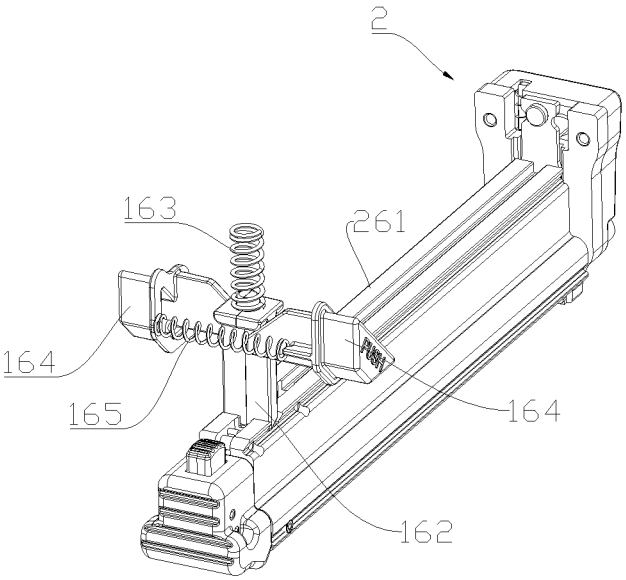
FIG. 32 is a schematic diagram of the fitting relationship between a sliding block and a fastener box component viewed from another angle according to Embodiment 6 of the present disclosure.
Figure 33:
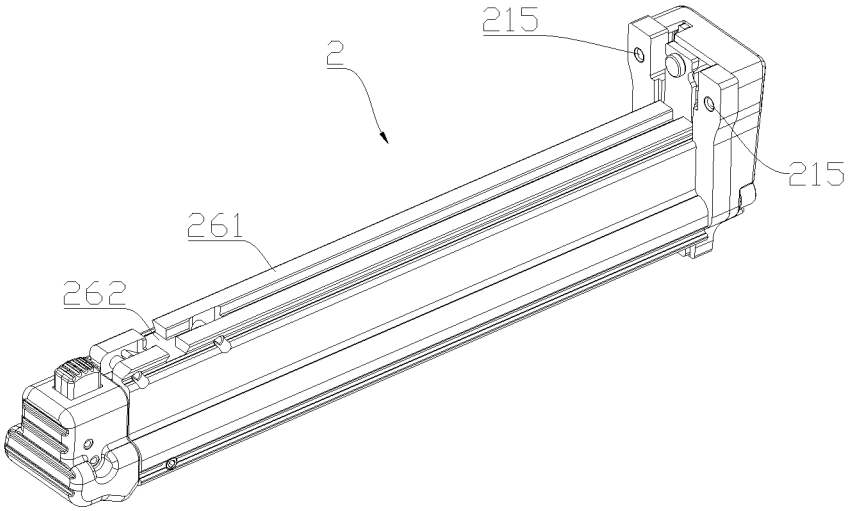
FIG. 33 is a schematic structural diagram of a fastener box component according to Embodiment 6 of the present disclosure.

The support portion 160 is provided with a cavity 161. A sliding block 162 is provided in the cavity 161. The sliding block 162 is movably arranged in the cavity 161. A first spring 163 is further provided in the cavity 161. One end of the first spring 163 abuts against the support portion 160, and the other end abuts against the sliding block 162. As shown in FIGS. 31 and 32, the first spring 163 is located above the sliding block 162. The sliding block 162 moves upward to abut against the first spring 163 to enable the first spring 163 to deform. The deformed first spring 163 may enable the sliding block 162 to reset. In a normal state, the sliding block 162 protrudes downward from the support portion 160. Two buttons 164 are provided on the support portion 160. The two buttons 164 are movably arranged penetrating the support portion 160. The two buttons 164 are respectively arranged on two sides of the sliding block 162. The two buttons 164 may move toward each other. The buttons 164 moves to abut against the sliding block 162 to enable the sliding block 162 to move upward. Two second springs 165 are further provided in the cavity 161. Two ends of the second spring 165 abut against the two buttons 164. When the buttons 164 are pressed toward each other, the two second springs 165 are compressed. The compressed second springs 165 may enable the buttons 164 to reset. A lower surface of the support portion 160 is provided with a dovetail groove 166. The dovetail groove 166 extends along the support portion 160.

An upper surface of the fastener box component 2 is provided with a dovetail 261 and a second groove 262. The dovetail 261 is used to fit with the dovetail groove 166 and is plugged in the dovetail groove 166 to be movable along the dovetail groove 166. The second groove 262 is arranged on the dovetail 261. After the fastener box component 2 is installed in position, the second groove 262 and the sliding block 162 are opposite each other. The sliding block 162 is partially plugged in the second groove 262, such that the fastener box component 2 cannot continue to move along the dovetail groove 166 and thus cannot be detached. The driving portion 103 is provided with a first pin post 1034. The fastener box component 2 is provided with a first pin hole 215. The fitting relationship between the first pin post 1034 and the first pin hole 215 is as discussed above.

During installation, the dovetail 261 is plugged in the dovetail groove 166 and slides along the dovetail groove 166. When the fastener box component 2 moves to the sliding block 162, the dovetail 261 abuts against the sliding block 162 to push up the sliding block 162 until the second groove 262 moves to the sliding block 162. The sliding block 162 is driven by the first spring 163 to be inserted in the second groove 262. The sliding block 162 restricts the movement of the fastener box component 2 on the gun body 1. When the sliding block 162 is inserted in the second groove 262, the first pin post 1034 is inserted in the first pin hole 215.

In this embodiment, a connecting piece is a dovetail groove 166 and a first pin post 1034, and a first alignment structure is respectively a dovetail 261 and a first pin hole 215. A locking piece is a sliding block 162, and a second alignment structure is a second groove 262. A disassembly direction of the fastener box component 2 is the movement from left to right. The sliding block 162 restricts the transverse movement of the fastener box component 2 to restrict the disassembly of the fastener box component 2. The dovetail groove 166 and the dovetail 261 may achieve a connection effect and may further achieve a guiding effect, and thus the two may also be referred to as a guide structure and a fitting structure.

In this embodiment, the first spring 163 is a first elastic reset device. The second spring 165 is a second elastic reset device. For the structure described in this embodiment, the structure or a conventional structure in the foregoing embodiment may be used.

Figure 34:
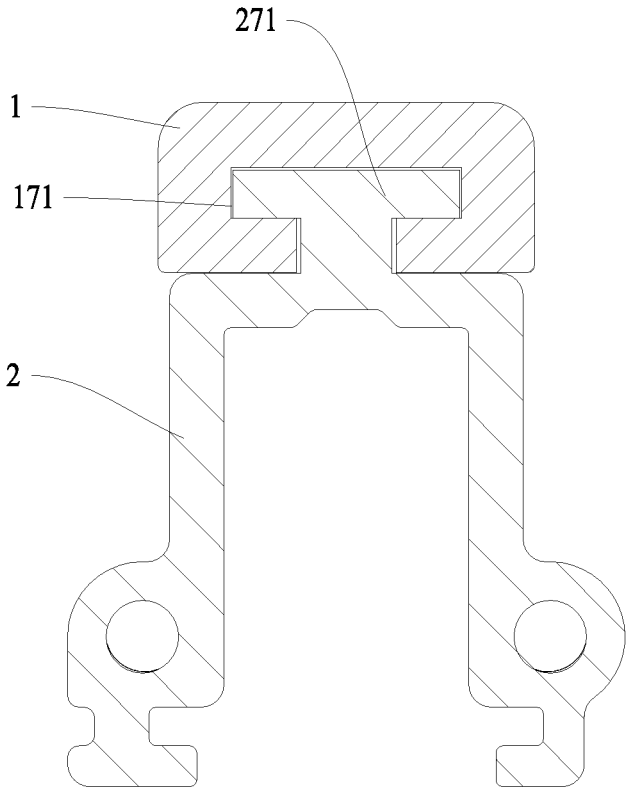
FIG. 34 is a schematic diagram of another embodiment of a connection manner of a gun body and a fastener box component according to the present disclosure.

FIG. 34 shows another embodiment of a connection manner between the gun body 1 and the fastener box component 2 in the present disclosure. The fastener box component 2 is provided with a square tenon 271. The gun body 1 is provided with a square mortise 171. The square tenon 271 fits with the square mortise 171 such that the gun body 1 is connected to the fastener box component 2.

Figure 35:
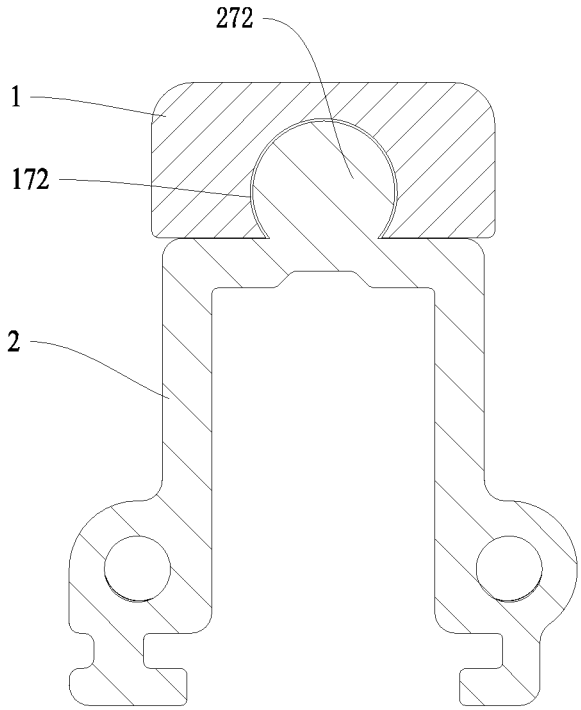
FIG. 35 is a schematic diagram of another embodiment of a connection manner of a gun body and a fastener box component according to the present disclosure.
Figure 36:
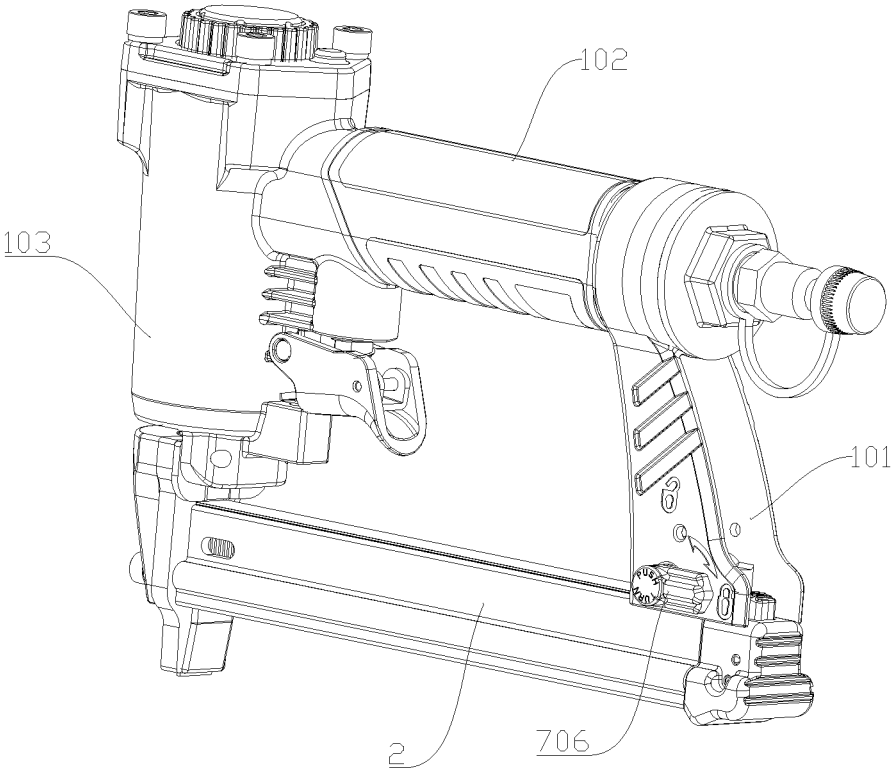
FIG. 36 is a schematic structural diagram of a fastener gun according to Embodiment 7 of the present disclosure.
Figure 37:
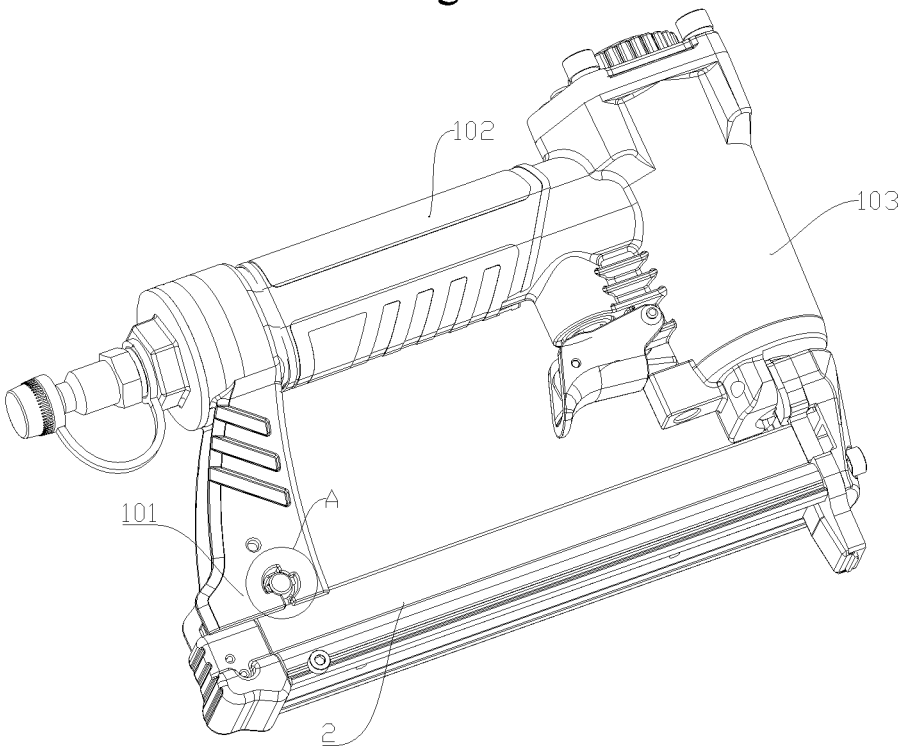
FIG. 37 is a schematic structural diagram of a fastener gun viewed from another angle according to Embodiment 7 of the present disclosure.
Figure 38:
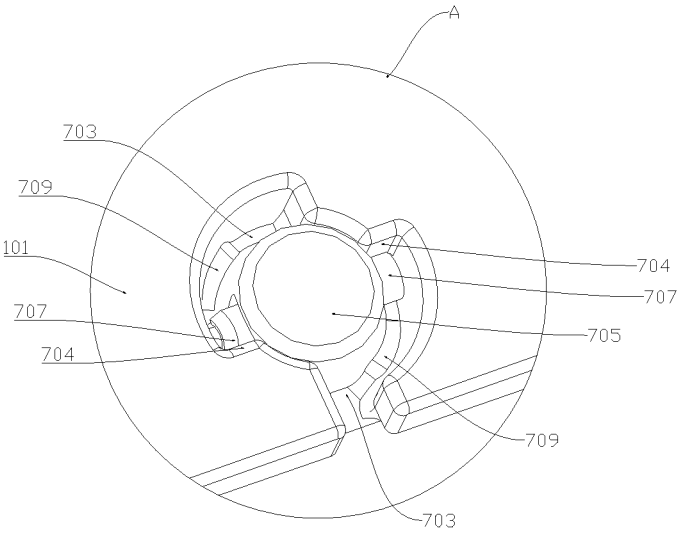
FIG. 38 is a schematic structural diagram of part A in FIG. 37.
Figure 39:
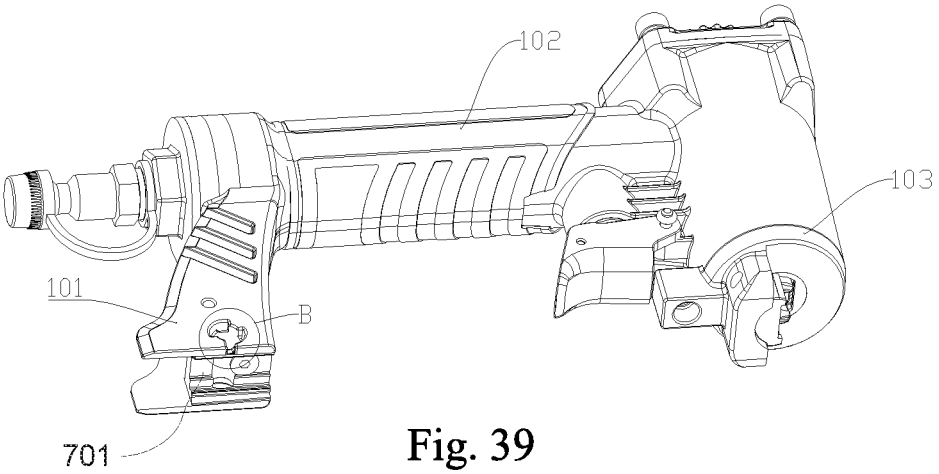
FIG. 39 is a schematic structural diagram of a gun body according to Embodiment 7 of the present disclosure.
Figure 40:
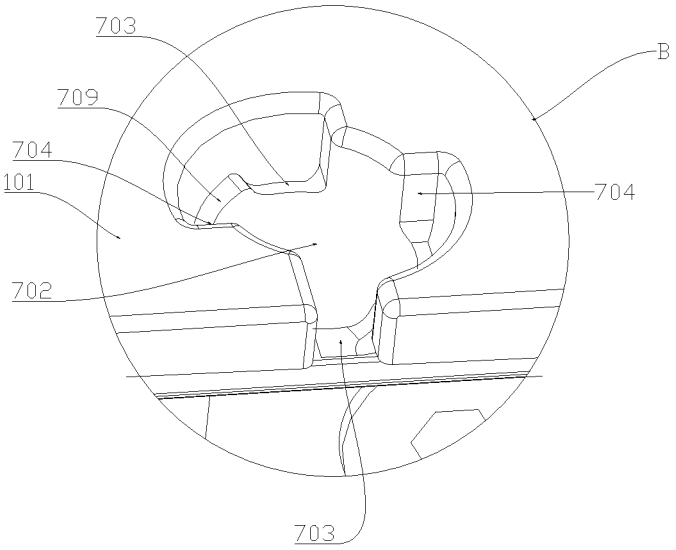
FIG. 40 is a schematic structural diagram of part B in FIG. 39.
Figure 41:
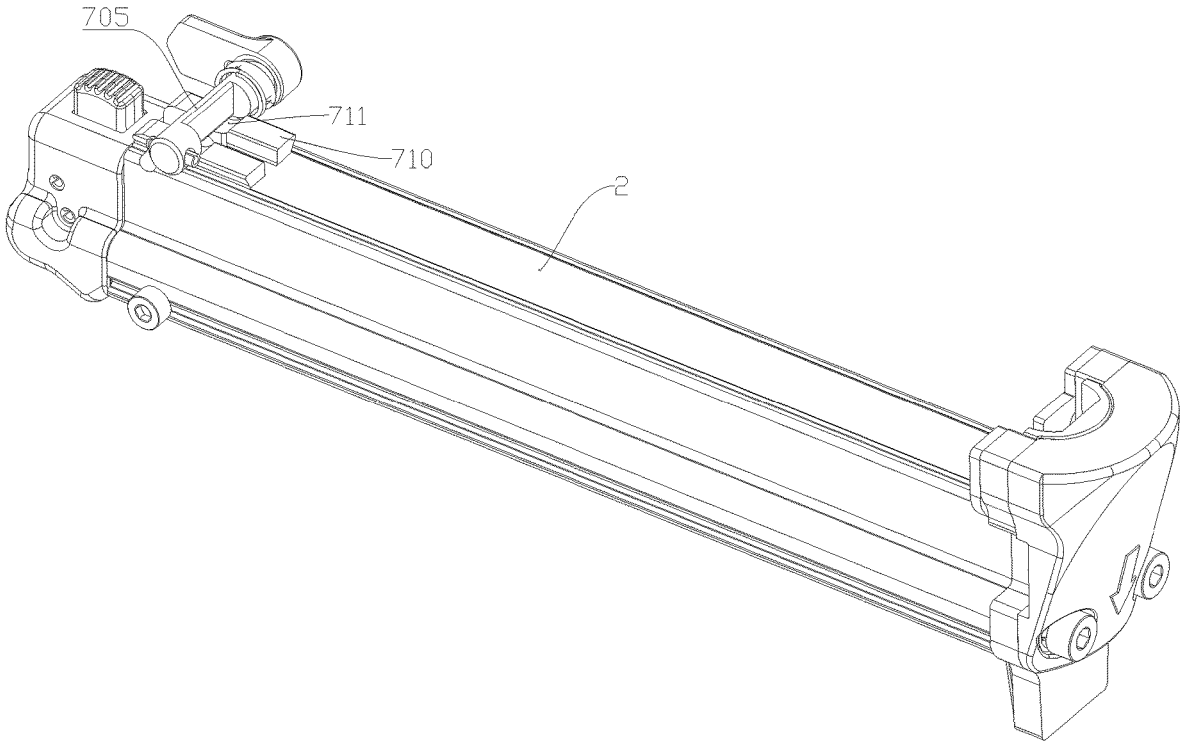
FIG. 41 is a schematic structural diagram of the fitting relationship between an eccentric piece and a fastener box component according to Embodiment 7 of the present disclosure.
Figure 42:
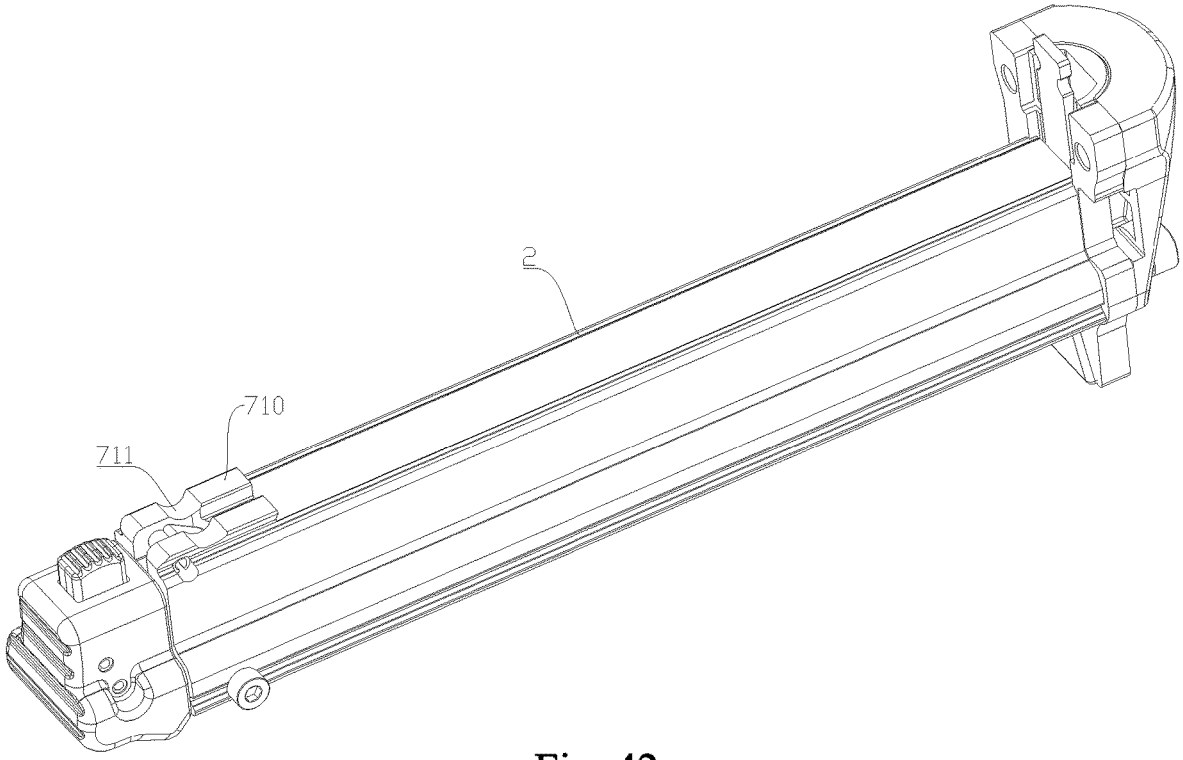
FIG. 42 is a schematic structural diagram of a fastener box component according to Embodiment 7 of the present disclosure.
Figure 43:
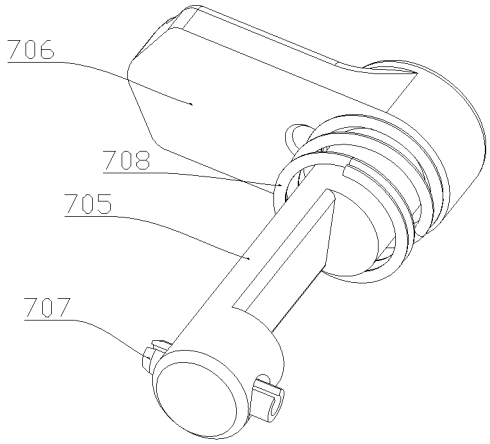
FIG. 43 is a schematic diagram of an eccentric piece and a related structure thereof according to Embodiment 7 of the present disclosure.

FIG. 35 shows another embodiment of a connection manner between the gun body 1 and the fastener box component 2 in the present disclosure. The fastener box component 2 is provided with a circular tenon 272. The gun body 1 is provided with a circular mortise 172. The circular tenon 272 fits with the circular mortise 172 such that the gun body 1 is connected to the fastener box component 2.

Embodiment 7

As shown in FIG. 36 to FIG. 43, the lower end of the connecting portion 101 is provided with a first dovetail groove 701 and a counterbore 702. A step 709 is provided in the counterbore 702. The counterbore 702 is provided with a fourth groove 703 and a stop wall 704. The fourth groove 703 and the stop wall 704 respectively extend in opposite directions from the step 709. An extension direction of the first dovetail groove 701 is perpendicular to an axial direction of the counterbore 702.

The connecting portion 101 is provided with an eccentric piece 705. The eccentric piece 705 is rotatably arranged. The eccentric piece 705 may be an eccentric shaft or a shaft with a semicircular sectional surface or an arc-shaped sectional surface. The eccentric piece 705 is rotatably plugged in the counterbore 702. One end of the eccentric piece 705 is provided with a handle 706, and the other end is provided with a clamping pin 707. The clamping pin 707 penetrates the eccentric piece 705 and protrudes from the eccentric piece 705 from two sides. The clamping pin 707 is located in the counterbore 702 and is rotatable along with the eccentric piece 705. The stop wall 704 is located in a rotational direction of the eccentric piece 705 and is used to restrict a rotation angle of the eccentric piece 705. The clamping pin 707 rotates along the step 709 and may enter the fourth groove 703 during rotation. The eccentric piece 705 is sleeved with a compression spring 708, also referred to herein as a fifth elastic reset device. One end of the compression spring 708 abuts against the connecting portion 101, and the other end abuts against the handle 706. The compression spring 708 has an elastic force when being compressed. The elastic force abuts against the handle 706 to enable the clamping pin 707 to abut against the connecting portion 101. For example, the clamping pin 707 needs to move out of the fourth groove 703 to abut against the step 709. The compression spring 708 needs to be pressed to enable the elastic force of the compression spring 708 to further increase. In this case, the clamping pin 707 abuts against the connecting portion 101 with a greater force. That is, when the clamping pin 707 abuts against the step 709, the clamping pin is more difficult to rotate than in the fourth groove 703, that is, the clamping pin is more stable.

The fastener box component 2 is provided with a first dovetail 710, also referred to herein as a stop block 710. The first dovetail 710 may be plugged in the first dovetail groove 701 and may slide in an extension direction of the first dovetail groove 701. The first dovetail 710 is provided with an eighth groove 711. The first dovetail 710 is plugged in the first dovetail groove 701. After the fastener box component 2 is installed in position, the eccentric piece 705 rotates by a particular angle to be partially plugged in the eighth groove 711. The eccentric piece 705 may block a first dovetail 711, to prevent the first dovetail 711 from exiting from the first dovetail groove 701, that is, prevent the fastener box component 2 from being detached. In this way, the fastener box component 2 may be locked to the connecting portion 101. In this embodiment, when the eccentric piece 705 is located in the eighth groove 711, and the clamping pin 707 is located outside the fourth groove 703 and abuts against the step 709. Therefore, when the eccentric piece 705 is located in a state of being locked at the fastener box component 2, a greater force is required to rotate the eccentric piece 705. The fastener box component 2 is locked more stably.

In this embodiment, the first dovetail groove 701 is both an embodiment of a connecting piece and an embodiment of a guide structure; and the first dovetail 710 is both an embodiment of a first alignment structure and an embodiment of a fitting structure. In addition, after the first dovetail 710 is provided with the fourth groove 703, the first dovetail 710 is divided into two convex blocks, constituting an embodiment of a second alignment structure. The eccentric piece 705 is an embodiment of a locking piece.

Embodiment 8

Figure 44:
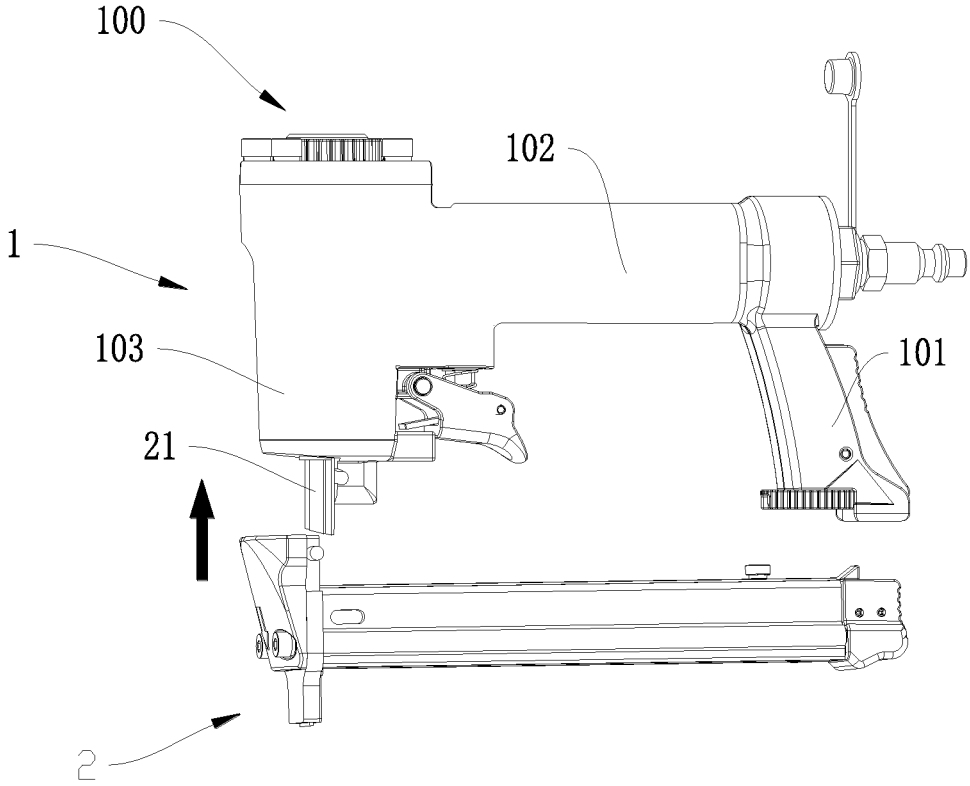
FIG. 44 is a schematic structural diagram of a fastener gun according to Embodiment 8 of the present disclosure.

As shown in FIG. 44, a difference between in this embodiment and Embodiment 4 lies in that the fastening member 21 is not installed on the fastener box component 2, but instead is connected to the power member 13 in advance. When the fastener box component 2 is connected to the gun body 1, the power member 13 drives the fastening member 21 to retract into the gun body 1, and the fastener box component 2 moves to be connected to the gun body 1 in the arrow direction. Before the fastener box component 2 is installed on the gun body 1, the power member 13 is driven by power air to drive the fastening member 21 to move upward, to prevent the fastening member 21 from preventing the installation of the fastener box component 2.

The fastening member 21 in another embodiment may also be, for example, independent of the fastener box component 2 as in Embodiment 8, and before the fastener box component 2 is connected to the gun body 1, the fastening member 21 is connected to the power member 13 in advance.

Embodiment 9

Figure 45:
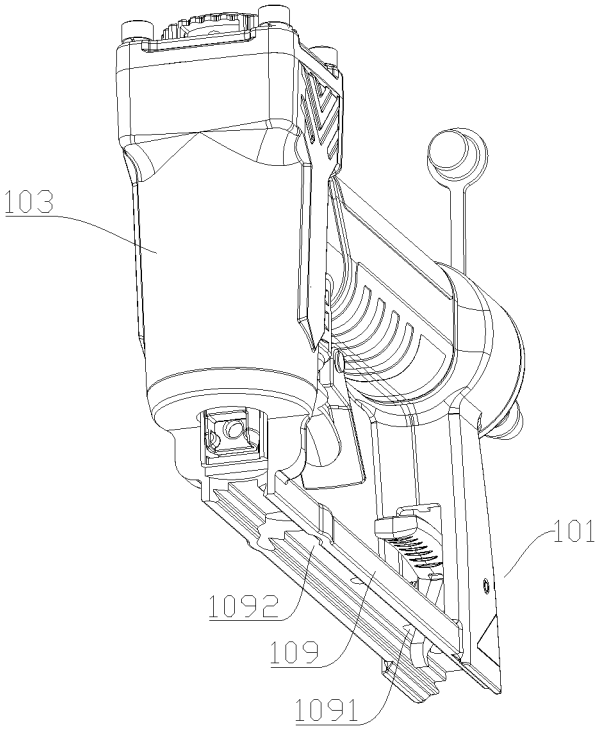
FIG. 45 is a schematic structural diagram of a gun body according to Embodiment 9 of the present disclosure.
Figure 46:
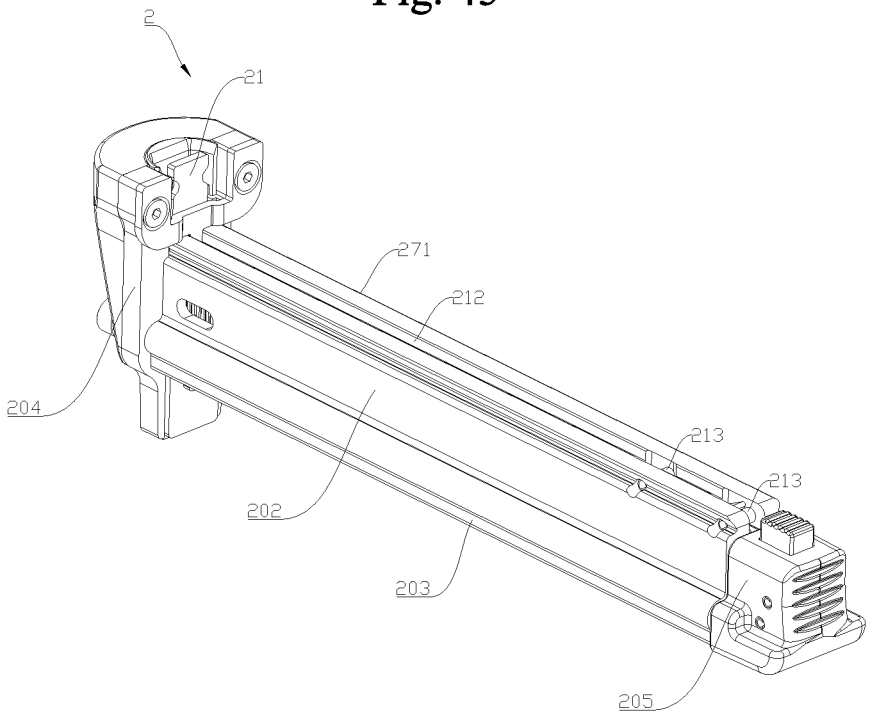
FIG. 46 is a schematic structural diagram of a fastener box component according to Embodiment 9 of the present disclosure.

As shown in FIGS. 45 and 46, a difference between this embodiment and Embodiment 1 lies in that, in this embodiment, the first pin post 1034 is not arranged on the fastener box component 2. A power portion 103 is not provided with a first pin hole 215. The shape of the convex block 271 has a form of a dovetail, and the third groove 1092 is a dovetail groove. A connection between the fastener box component 2 and the gun body 1 is implemented relying on the fitting between the dovetail groove and the dovetail and the fitting between the first locking hook 107 and the pin shaft 213. The remaining structure is the same as that in Embodiment 1.

Embodiment 10

Figure 47:
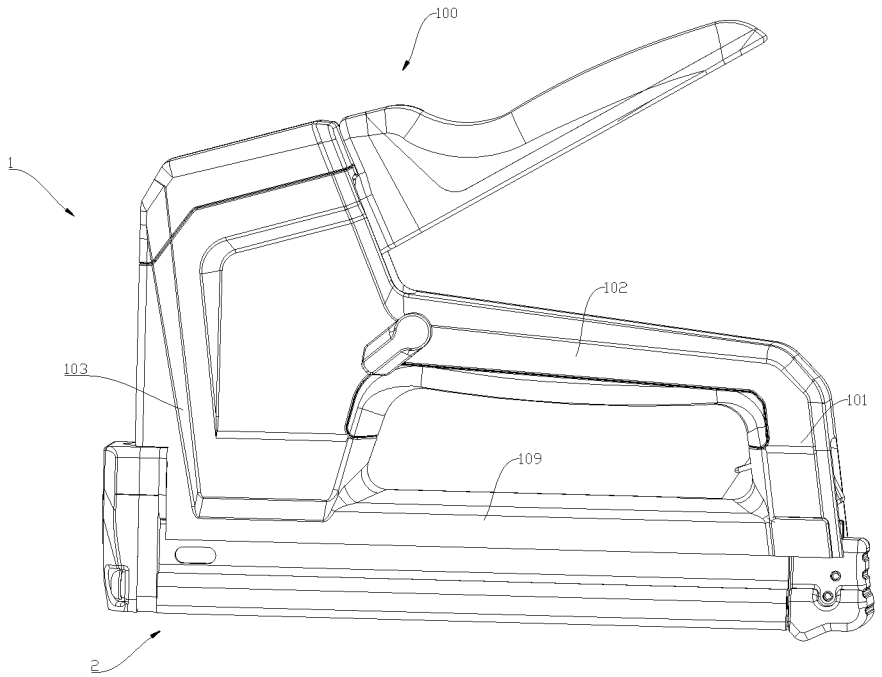
FIG. 47 is a schematic structural diagram of a fastener gun according to Embodiment 10 of the present disclosure.
Figure 48:
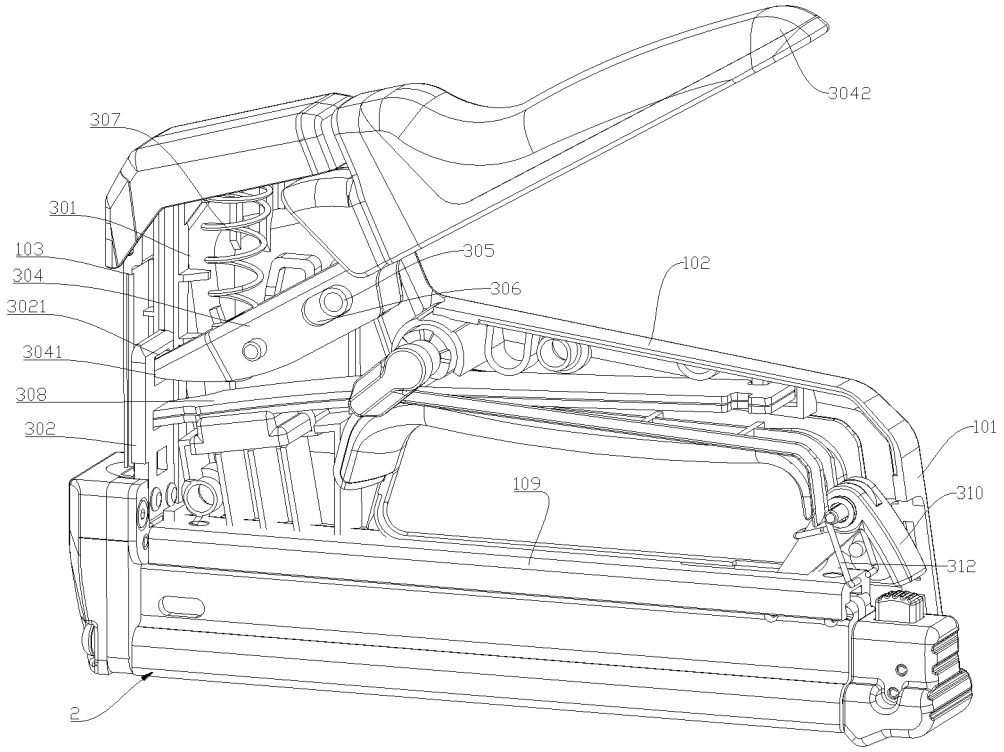
FIG. 48 is a schematic diagram of an internal structure of a gun body of a fastener gun according to Embodiment 10 of the present disclosure.

As shown in FIGS. 47 and 48, the power for fastening in this embodiment is different from that in the foregoing embodiment. A fastener gun with manual fastening is used in this embodiment. As shown in the figure, the gun body 1 comprises a connecting portion 101, a grasping portion 102, a driving portion 103, and a crossbeam 109. The driving portion 103 is provided with an accommodating cavity 301. The accommodating cavity 301 is provided with a sliding block 302 that may slide vertically. The sliding block 302 is provided with a jack 3021. A lever 304 is installed rotatably around the shaft 305. The shaft 305 is fastened in the accommodating cavity 301. The lever 304 is provided with a slide groove 306. The shaft 305 penetrates the lever 304 along the slide groove 306. The size of the slide groove 306 is greater than that of the shaft 305 to enable the lever 304 to be rotatable around the shaft 305 and further movable relative to the shaft 305. One end 3041 of the lever 304 is plugged in the jack 3021 of the sliding block 302 and may move out of the jack 3021. The other end 3042 of the lever 304 extends out of the gun body 1 to facilitate pressing by an operator. The accommodating cavity 301 is provided with a fifth spring 307. One end of the fifth spring 307 abuts against the lever 304, and the other end abuts against the driving portion 103. An elastic sheet 308 is further provided in the accommodating cavity 301. One end of the elastic sheet 308 is fastened, and the other end is connected to the sliding block 302. The sliding block 302 moves upward to enable the elastic sheet 308 to deform to generate an elastic force. The elastic force of the elastic sheet 308 may enable the sliding block 302 to move downward to drive the fastening member 21 for fastening.

During fastening, the other end of the lever 304 is pressed to enable the lever 304 to rotate around the shaft 305. The lever 304 rotates to enable the sliding block 302 to move upward and drive the elastic sheet 308 to deform. The lever 304 rotates to slide to the right relative to the shaft 305. At the same time when the sliding block 302 moves upward, the lever 304 slides to the right until the lever 304 moves out of the jack 3021 of the sliding block 302. The sliding block 302 moves downward under the effect of the elastic sheet 308 to perform fastening. After pressing is released, the lever 304 resets under the effect of the fifth spring 307, and an end portion is inserted in the jack 3021 again.

The solution in any foregoing embodiment may be used for a connection solution between the fastener box component 2 and the gun body 1. As shown in the figures, referring to the connection solution between the fastener box component 2 and the gun body 1 in Embodiment 1, the connecting portion 101 in this embodiment is connected to a second locking hook 310. The second locking hook 310 has a V shape. An end portion of the second locking hook 310 is provided with a hook body (not shown in the figure). The hook body is used to hook the pin shaft 213 on the fastener box component 2. A second torsion spring 312 is further installed on the connecting portion 103. The second locking hook 310 rotates to enable the second torsion spring 312 to deform to generate an elastic force. The elastic force may enable the second locking hook 310 to reset to be kept in a state of hooking the pin shaft 213. During use, the second locking hook 310 hooks the pin shaft 213, and the connecting portion 101 is connected to the fastener box component 2. The second torsion spring 312 enables the second locking hook 310 to be kept in the state. The second locking hook 310 is pushed with a hand to rotate clockwise, and after a hook body 311 unhooks the pin shaft 213, the fastener box component 2 can be removed. In this case, the second torsion spring 312 deforms to generate an elastic force. The elastic force may enable the second locking hook 310 to reset and can help the second locking hook 310 to stably keep hooking at the position of the pin shaft 213.

In this embodiment, the first locking hook 107 and the second locking hook 310 are both locking hooks, and are generally referred to as a locking hook. The first torsion spring 108 and the second torsion spring 312 are respectively an embodiment of a sixth elastic reset device.

The power member 13 has an initial position and an end position during movement. The power member 13 shown in FIGS. 4 and 5 is at the end position. The initial position of the power member 13 is above the end position, and is generally at the top (e.g., further away from the fastener box component as compared to the end position) of the accommodating cavity 1221. The power member 13 moves from the initial position to the end position to drive the fastening member 21 to launch a fastener. As discussed with regard to Embodiment 8, the fastening member 21 may be first connected to the power member 13 before the fastener box component 2 is connected to the gun body 1. The initial positions of the power member 13 and the fastening member 21 are in the gun body 1. Before the fastener box component 2 is connected to the gun body 1, the power member 13 drives the fastening member 21 to move to a position where the occurrence of the fastener box component 2 being prevented from installation can be avoided, and the fastener box component 2 is then connected to the gun body 1. During fastening, the power member 13 carries the fastening member 21 to move from the initial position to the end position to implement fastening.

When the fastening member 21 is first connected to the fastener box component 2 and is then connected to the power member 13, the initial position of the power member 13 overlaps the end position. When the power member 13 is located in the end position, the fastener box component 2 is then connected to the gun body 1 such that the power member 13 is connected to the fastening member 21 at the same time. During fastening, the power member 13 carries the fastening member 21 to move away from the initial position, and then returns to the initial position under the effect of power to implement fastening.

"Up", "down", "left", and "right" according to the present disclosure are used for clear description of this embodiment. Refer to FIG. 5 for the used relative concept.

In the foregoing embodiments of the present disclosure, a pneumatic staple gun is used as an example for description. However, the present disclosure is not restricted to a pneumatic staple gun. For the power, regardless of a pneumatic manner, an electric manner or a manual manner, the implementation of the objective of the present disclosure is not affected. The present disclosure is not only restricted to a staple gun, and may further be applicable to a rivet or the like.

According to the fastener box component, the fastener gun, and the method for replacing a fastener box component of a fastener gun of the present disclosure, multiple fastener box components fit with the same gun body in a same connection manner, and the fastener box components are detachable and replaceable, such that one gun body can be equipped with multiple fastener box components, and each fastener box component holds one specification of fasteners, which can not only reduce the purchase cost of users, but also satisfy the needs of quickly changing fasteners of different models. The fastening member may be respectively arranged, or may be arranged on the fastener box component and connected to the power member as the fastener box component is installed on the gun body, so that there are a variety of operation manners and the use is convenient. The same fastening member may fit with multiple fastener box components. The connecting piece fits with the locking piece, which can not only conveniently install and remove the fastener box component, but also ensure that the fastener box component is firmly installed to ensure the safety during use.

The foregoing embodiments are not intended to restrict the present disclosure. However, the present disclosure is not restricted to the foregoing examples. Changes, variations, additions or replacements made by a person skilled in the art without departing from the scope of the technical solutions of the present disclosure all fall within the scope of protection of the present disclosure.

The invention claimed is:

1. A fastener gun, comprising:

a gun body;

a power member disposed within the gun body and movably arranged;

a fastener box component including a fastener member, a fastener accommodating cavity, and a fastening channel;

wherein the fastener member is arranged to be driven by the power member to move to launch a fastener, and wherein the fastener member is located on a movement path of the power member;

wherein the fastening channel is in communication with the fastener accommodating cavity;

wherein the fastener accommodating cavity is used to accommodate fasteners, and the fastening channel is used to provide a channel through which a fastener is launched out of the fastener box component; and wherein the fastener box component is detachably connected to the gun body.

2. The fastener gun according to claim 1, wherein there are a plurality of fastener box components, and the plurality of fastener box components are respectively detachably connected to one same gun body in a same connection manner.

3. The fastener gun according to claim 1, wherein the fastener box component is connected to the gun body by a connecting piece and/or a locking piece.

4. The fastener gun according to claim 3, wherein the fastener box component is detachably connected to the gun body by the connecting piece, and the locking piece restricts the fastener box component and the gun body from relatively moving in a disassembly direction.

5. The fastener gun according to claim 3, further comprising a first alignment structure, wherein the connecting piece fits with the first alignment structure such that the gun body is detachably connected to the fastener box component; and wherein the connecting piece is arranged on one of the fastener box component and the gun body, and the first alignment structure is arranged on the other of the fastener box component and the gun body.

6. The fastener gun according to claim 5, wherein the connecting piece is a first pin post, a second pin post, a dovetail, and/or a tenon, and the first alignment structure is a first pin hole, a first groove, a dovetail groove and/or a mortise.

7. The fastener gun according to claim 3, further comprising a second alignment structure, wherein the locking piece fits with the second alignment structure to restrict the gun body and the fastener box component from relatively moving in a disassembly direction; and wherein the locking piece is arranged on one of the fastener box component and the gun body, and the second alignment structure is arranged on the other of the fastener box component and the gun body.

8. The fastener gun according to claim 7, wherein the locking piece is a locking hook that is movably arranged; the second alignment structure is a pin shaft, and the locking hook is configured to, after being moved, hook the pin shaft and unhook the pin shaft; and/or wherein the locking piece is a knob, and the second alignment structure is a pin, and the knob is rotatably arranged, and the knob is configured to hook the pin after being rotated; and/or wherein the locking piece is an eccentric piece, and the second alignment structure is a stop block, and the eccentric piece is rotatably arranged, and the eccentric piece is configured to, after being rotated, stop the stop block to prevent the fastener box component from being detached from the gun body; and/or wherein the locking piece is a sliding block, and the second alignment structure is a second groove; and the sliding block is movably arranged, and the sliding block is configured to, when being moved, be inserted in the second groove or move out of the second groove.

9. The fastener gun according to claim 8, wherein the locking piece is the sliding block, and the second alignment structure is the second groove; and the fastener gun further comprises a button that is movably arranged; and wherein the button is configured to, when being moved, drive the sliding block to move the sliding block out of the second groove.

10. The fastener gun according to claim 9, wherein the sliding block is arranged inside the gun body, and when the button is moved, the button abuts against the sliding block to move the sliding block.

11. The fastener gun according to claim 10, further comprising a first elastic reset device and a second elastic reset device, wherein when the sliding block is moved, the first elastic reset device is deformed to generate an elastic force by which the sliding block is reset; and when the button is moved, the second elastic reset device is deformed to generate an elastic force by which the button is reset.

12. The fastener gun according to claim 8, wherein the eccentric piece is rotatably arranged on the gun body, and the stop block is arranged on the fastener box component; and wherein after the fastener box component is installed on the gun body, the eccentric piece is located, after being rotated, in a direction in which the stop block is disassembled from the fastener box component so as to prevent the stop block from being disassembled from the fastener box component.

13. The fastener gun according to claim 12, wherein one end of the eccentric piece is provided with a clamping pin, and the other end thereof is provided with a handle;

wherein the clamping pin is configured to protrude from the eccentric piece;

wherein the clamping pin and the handle are respectively located on two sides of the gun body;

wherein the gun body is provided with a fourth groove used to accommodate the clamping pin, and the clamping pin is configured to be able to enter the fourth groove and move out of the fourth groove;

wherein a fifth elastic reset device is arranged between the handle and the gun body, and the fifth elastic reset device is configured to be elastically deformable;

wherein the handle can be pressed to enable the clamping pin to move out of the fourth groove and enable the fifth elastic reset device to deform to generate an elastic force that enables the clamping pin to abut against the gun body;

wherein and rotating the handle enables the eccentric piece to stop the stop block; and wherein when the clamping pin is located outside the fourth groove, the eccentric piece is in a state of stopping the stop block.

14. The fastener gun according to claim 13, wherein the gun body is provided with a counterbore and the clamping pin is located in the counterbore;

wherein the counterbore has a stop wall provided therein; and wherein the stop wall is located on a rotating path of the clamping pin and is used to restrict a rotation angle of the clamping pin.

15. The fastener gun according to claim 8, further comprising a sixth elastic reset device, wherein the locking hook is rotatably arranged; and wherein when the locking hook is rotated to enable the locking hook to unhook the pin shaft, the locking hook is configured to enable the sixth elastic reset device to generate elastic deformation or have increased deformation.

16. The fastener gun according to claim 8, wherein the pin comprises a pin body and a pin cap, and the pin cap is connected to the pin body and protrudes from the pin body;

wherein the knob is provided with an accommodating cavity, an inlet, and a curved groove, and the inlet and the curved groove are both in communication with the accommodating cavity;

wherein the pin cap can enter the accommodating cavity through the inlet and the pin body is movable along the curved groove; and wherein when the pin body moves along the curved groove, the pin cap is restricted to move in the accommodating cavity.

17. The fastener gun according to claim 1, wherein the power member is configured to be driven by a form of power to bidirectionally move back and forth.

18. The fastener gun according to claim 1, wherein when the fastener box component is connected to the gun body, the fastener member is detachably connected to the power member; and wherein after the fastener member is connected to the power member, the fastening fastener member is driven by the power member to move relative to the fastener box component.

19. The fastener gun according to claim 18, wherein the fastener box component is provided with a restriction piece, and the restriction piece is movably arranged;

wherein the restriction piece acts on the fastener member to restrict the fastener member in the fastening channel; and, wherein after the restriction piece is moved, restriction on the fastening member is released.

20. The fastener gun according to claim 18, wherein the fastener member is detachably connected to the power member in a manner such that one of the fastener member and the power member is provided with a convex post, and the other is provided with a notch, the convex post being embedded in the notch such that the fastener member is detachably connected to the power member; and/or wherein one of the fastener member and the power member is provided with a third pin post, and the other is provided with a second pin hole, the third pin post being inserted in the second pin hole such that the fastener member is detachably connected to the power member.

21. The fastener gun according to claim 1, further comprising a guide structure and a fitting structure, wherein the fitting structure fits with the guide structure to guide the installation and disassembly of the fastener box; and wherein the guide structure is arranged on one of the gun body and the fastener box component, and the fitting structure is arranged on the other of the gun body and the fastener box component.

22. The fastener gun according to claim 21, wherein the guide structure is one of a dovetail and a dovetail groove, and the fitting structure is the other of the dovetail and the dovetail groove; and/or wherein the guide structure is one of a tenon and a mortise, and the fitting structure is the other of the tenon and the mortise; and/or wherein the guide structure is one of a convex block and a third groove, and the fitting structure is the other of the convex block and the third groove.

23. The fastener gun according to claim 21, wherein the gun body comprises a crossbeam, and the guide structure or the fitting structure is arranged on the crossbeam.

* * * * *